US009993849B2

(12) United States Patent
Kamen et al.

(10) Patent No.: US 9,993,849 B2
(45) Date of Patent: Jun. 12, 2018

(54) APPARATUS AND METHOD FOR CLEANING OBJECTS

(71) Applicant: DEKA Products Limited Partnership, Manchester, NH (US)

(72) Inventors: Dean Kamen, Bedford, NH (US); David H. Bellman, Hooksett, NH (US); Alexander R. Therrien, Zionsville, IN (US); Jared N. Farlow, Boston, MA (US); Keith D. Violette, Sandown, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days. days.

(21) Appl. No.: 15/651,674

(22) Filed: Jul. 17, 2017

(65) Prior Publication Data

US 2017/0312792 A1 Nov. 2, 2017

Related U.S. Application Data

(63) Continuation of application No. 13/755,503, filed on Jan. 31, 2013, now Pat. No. 9,707,601.

(51) Int. Cl.

| | |
|---|---|
| ***B08B 3/04*** | (2006.01) |
| ***A47L 15/50*** | (2006.01) |
| ***A47L 25/00*** | (2006.01) |
| ***B08B 11/02*** | (2006.01) |

(52) U.S. Cl.

CPC ..... *B08B 3/047* (2013.01); *A47L 15/505* (2013.01); *A47L 25/00* (2013.01); *B08B 11/02* (2013.01)

(58) Field of Classification Search

CPC ..... B08B 3/047; A47L 25/00; A47L 15/505

See application file for complete search history.

(56) References Cited

U.S. PATENT DOCUMENTS

| | | | | |
|---|---|---|---|---|
| 4,870,982 | A * | 10/1989 | Liu | A47L 25/00 134/1 |
| 5,209,784 | A * | 5/1993 | Bellman | A47L 15/505 134/135 |
| 6,076,538 | A * | 6/2000 | Frankson | A47L 21/00 134/117 |
| 6,277,011 | B1 * | 8/2001 | Moreillon | B24B 31/05 451/32 |

(Continued)

*Primary Examiner* — Michael Barr
*Assistant Examiner* — Benjamin L Osterhout
(74) *Attorney, Agent, or Firm* — Michelle Saquet Temple

(57) ABSTRACT

A container is disclosed. The container includes a top portion and a bottom portion, both including a mesh portion, at least one hinging feature attached to the bottom portion, wherein the at least one hinging feature hingably attaches the top portion to the bottom portion, wherein the top portion and the bottom portion having an open configuration and a closed configuration and wherein the top portion and the bottom portion, when in the closed configuration, forming an inner portion, also a latching mechanism wherein when the latching mechanism is in a locked position the top portion and bottom portion are locked into the closed configuration, also at least one spring holder attached to the at least one hinging feature and located within the inner portion wherein when the top portion and bottom portion move from the closed position to the open position, the at least one spring holder lifts upwards.

20 Claims, 40 Drawing Sheets

(56) References Cited

U.S. PATENT DOCUMENTS

| | | | | |
|---|---|---|---|---|
| 6,502,589 | B1 * | 1/2003 | Fitzgerald | B08B 3/044 134/117 |
| 2004/0178061 | A1 * | 9/2004 | Accattato | B08B 3/00 204/241 |
| 2008/0121253 | A1 * | 5/2008 | Shotwell | A47L 15/505 134/25.4 |
| 2009/0107856 | A1 * | 4/2009 | Egnatic | A47L 15/505 206/6.1 |
| 2010/0083455 | A1 * | 4/2010 | Hahn | B08B 3/047 15/257.01 |

* cited by examiner 202
204
206
208
210
212
214
216
218
220
222
224
226
228
230
232
234
236
238
240

APPARATUS AND METHOD FOR CLEANING OBJECTS

CROSS REFERENCE TO RELATED APPLICATION(S)

This application is a Continuation Application of U.S. patent application Ser. No. 13/755,503, filed Jan. 31, 2013 and entitled Apparatus and Method for Cleaning Objects, now U.S. Pat. No. 9,707,601 issued Jul. 18, 2017, which is hereby incorporated herein by reference in its entirety.

TECHNICAL FIELD

The present disclosure relates generally to cleaning and disinfecting objects, and more particularly, to an apparatus, a system, and a method for cleaning objects.

BACKGROUND INFORMATION

Jewelry and other small parts accumulate dirt, oils, and other contaminants that affect not only the aesthetic beauty of the item, but also its comfort and safety. Items such as rings, earrings, bracelets, and necklaces are commonly worn for long periods of time in close contact with the human body. Additionally, rings, bracelets, and other jewelry worn on the hands and wrist come into frequent contact with dirt, stains, pollutants and other environmental contaminants, many that contain or foster bacteria or other microorganisms. This problem is particularly acute for health care and food service workers. The accumulation of dirt and other contaminants leads to the loss of attractiveness of the jewelry, as well as to possible skin irritation to the wearer, and to the transmission of microorganisms to people or objects that contact the unclean jewelry.

Accordingly, there is a need to clean and sanitize jewelry and other small parts. However, the small size and intricate patterns of many jewelry items and small parts makes cleaning them difficult, tedious, and often ineffective. Given the expense of many jewelry items, cleaning procedures must be safe, gentle, and insure that small objects/parts, such as gemstones, are not dislodged and lost. As a result, most people have their jewelry cleaned by taking them to a professional jeweler; this is both inconvenient and expensive, and so is rarely done.

Automatic dishwashing machines provide the same elements used by some professional jewelers to clean jewelry; hot water mixed with a cleaning solution is pressurized and impinges upon the item. Automatic dishwashing machines are readily available, effective cleaning tools but are designed to hold and to maximize the cleaning of dishes, not jewelry. The present disclosure utilizes the ready availability of dishwashing machines, and their efficiency in cleaning and sanitizing large objects, while providing an apparatus and method for adapting these machines to safely and effectively clean and sanitize jewelry and other small items.

SUMMARY

In accordance with one aspect of the present disclosure, a container is disclosed. The container includes a top portion including a mesh portion, a bottom portion including a mesh portion, at least one hinging feature attached to the bottom portion, wherein the at least one hinging feature hingably attach the top portion to the bottom portion, wherein the top portion and the bottom portion having an open configuration and a closed configuration and wherein the top portion and the bottom portion, when in the closed configuration, forming an inner portion, a latching mechanism having a locked position and an unlocked position, wherein when the latching mechanism is in a locked position, the top portion and bottom portion are locked into the closed configuration, and at least one spring holder attached to the at least one hinging feature and located within the inner portion whereby when the top portion and bottom portion move from the closed position to the open position, the at least one spring holder lifts upwards.

In accordance with one aspect of the present disclosure, a method for cleaning jewelry and preventing the spread of bacteria through jewelry is disclosed. The method includes placing at least one item of jewelry into a container, the container including a top portion including a mesh portion, a bottom portion including a mesh portion, at least one hinging feature attached to the bottom portion, wherein the hinging features hingably attach the top portion to the bottom portion, wherein the top portion and the bottom portion having an open configuration and a closed configuration and wherein the top portion and the bottom portion, when in the closed configuration, forming an inner portion, a latching mechanism having a locked position and an unlocked position, wherein when the latching mechanism is in a locked position, the top portion and bottom portion are locked into the closed configuration, and at least one spring holder attached to the at least one hinging feature and located within the inner portion whereby when the top portion and bottom portion move from the closed position to the open position, the at least one spring holder lifts upwards. The method also includes placing the container into a dishwasher, adding dishwashing detergent to the dishwater, running the dishwasher through a washing cycle, and removing the at least one item of jewelry from the container.

In accordance with one aspect of the present disclosure, a specialized container and a method for using the container are provided where jewelry or other small items are safely contained while being subjected to a pressurized cleaning solution. The special container securely and safely positions the contained jewelry while it is subjected to the cleaning action from the pressure, heat, or chemical reactions of the solution. The container is designed to allow the cleaning solution to enter and exit its chamber and impact the contained items. This container and method for its use are part of a system for retaining, positioning, cleaning, and disinfecting jewelry and small parts/objects.

Some embodiments of the present disclosure include a top and a bottom member attached to one another by a fastening means and displaceable with respect to one another between an open and a closed position. In one embodiment the top and bottom members define a clamshell, so that when top and bottom are superimposed with each other in the closed position they define a main cavity for receiving jewelry or small parts/objects. A plurality of holes is formed substantially over at least the bottom surface to permit a cleaning fluid to enter and exit the main cavity and to impinge onto the jewelry and small parts/objects. In some embodiments, the top member contains a basin formed as a depression, and a reservoir located within the basin. The reservoir is a hollow container attached to the floor of the basin; the floor of the reservoir is perforated by at least one hole, making the interior of the reservoir connected with the main compartment. The reservoir has a displaceable top, and at least one wall defining a gutter that provides a passage between the basin and an interior reservoir cavity. Therefore, a continuous pathway exists for a cleaning solution to move between the basin, the reservoir cavity, and the main compartment; gutters connect the basin with the reservoir cavity, and holes connect the reservoir compartment with the main compartment. Dividing walls may optionally be added to partition the reservoir into at least two separate compartments, allowing different solutions to be added to each compartment. An engaging means secures the top and bottom members to contain jewelry or other small parts/objects within the main compartment.

In one embodiment of the present disclosure, the top member forms a removable cap that is operatively coupled to a sub-lid. The removable cap is formed of a heat resistant plastic material that forms slots that can be snapped into appropriately sized projections on the sub-lid. Other engaging means that allow a secure but removable connection between the cap and the sublid could also be used. The sublid defines a plurality of holes that allow the cleaning fluid to enter the main compartment from the external environment. Sublid may be formed from any suitable mesh material including but not limited to molded plastic mesh, hardware cloth, soft mesh, or other material that allows cleaning fluid to enter and exit main cavity but that has openings sized to prevent most small jewelry items from escaping. The sublid is connected to the bottom member by a fastening means that allows the rotation of the sublid on the bottom member to permit the container to be opened and closed. Removable caps can be configured for a wide variety of specialized functions including but not limited to containing at least one basin and reservoir system as discussed above, or forming a reinforcement cap that lacks the reservoir and basin system but has at least one opening that allows fluid to enter or exit the main chamber from the external environment.

In some embodiments, the mesh material is plastic mesh and is heat formed to retain a specified shape or form. In some embodiments, stainless steel mesh is used, and is stamped or otherwise shaped to retain a curvature or form. Mesh material can be permanently attached to a supporting frame or can be arranged as a soft bag that is fitted and stretched over a frame and thus can be removed and replaced. The large surface area of open space provided by a mesh arrangement allows a greater volume of cleaning fluid, and at a higher pressure, to enter the main cavity and to impinge upon the contained jewelry.

In another embodiment of the present disclosure, the top member could be spring loaded to be displaced when the container is in the unlocked position. In this embodiment, at least one brace extends from the back wall of the bottom element towards the front wall of the bottom element. This brace is positioned such that in its resting position the brace exerts an upward force against the top member, and such that this upward force is sufficient to slightly lift the top member. These braces could be further used to define at least one aperture sized to accommodate the posts of jewelry, such as earrings, or of other small items utilizing a post and stud attachment; the post of the earring would be inserted through the aperture on the brace and be secured by attaching the accompanying stud or other securing means on the opposite side of the brace.

In another embodiment of the present disclosure, the lower member is divided into at least two compartments. Each compartment is open at the top, has a bottom formed by the bottom of the second member, and partitioning walls that define a chamber. The partitioning walls are sized so that in the closed position the first member forms the roof of each compartment and contains jewelry or small parts/objects within an enclosed chamber. Partitioning walls may be made of molded mesh or other suitable material to allow the passage of cleaning fluid between the inside and outside of the chamber.

In one embodiment, closure of the cleaning apparatus defines multiple compartments. Each of these separate chambers may be formed by the molded frame, by extensions of the mesh covering, or by internal walls. Compartments may be sized to accommodate one or more pieces of jewelry of various sizes. Compartments may be completely segregated when the cleaner is closed, or may have connections to adjoining compartments that are sufficiently large to allow water flow, but that act as barriers to jewelry movement.

In another embodiment of the present disclosure, a dial is the means to reversibly couple the first and second members, and to allow the container to be opened and closed. The dial is rotatably attached to the second member, and defines a groove on its interior surface that is sized to accommodate a projection from the first member. The groove extends to a margin of the dial to allow the projection to enter the groove. When the dial is in one orientation, the projection can enter and exit the groove; when the dial is rotated to another orientation, the projection is secured within the groove and the container is in the locked position. Other means to reversibly fasten the top and bottom parts of the present disclosure would be apparent to one skilled in the art.

In another embodiment of the present disclosure, rotation of the dial between the locked and unlocked positions exposes different colors of a two-colored surface. One color is visible only when the dial is in the locked position and communicates to the user that the container cannot be opened, the other color is visible only when the dial is rotated to the unlocked position and communicates that the container can be opened. Ideally, the color communicating the unlocked and openable position is green, and the color communicating the locked and unopenable position is red.

In various embodiments, removable inserts define channels, micro-channels, and other pathways to distribute fluid and chemical solutions to the main cavity. In one embodiment, these inserts are constructed from a malleable substance including but not limited to rubber, plastic, foam, and elastomers.

In various embodiments attaching devices for securing and positioning jewelry and other objects are secured to the removable inserts and/or to the cleaning unit. In one embodiment, the attaching device is a detachable mesh bag that is secured to the cleaning unit by magnetic attraction.

In some embodiments of the present disclosure, a rigid frame is covered by a plastic mesh or by a fabric mesh.

In some embodiments of the disclosure the width of the cleaning unit is sized to fit within the trough created between the tines of a standard dishwashing rack.

A further object of the present disclosure is to provide a method for cleaning jewelry and small parts/objects using the specialized container described above to removably and nondamagingly contain the jewelry and small parts/objects while they are subjected to pressurized cleaning fluid. The method includes the steps of: placing the jewelry or other small parts/objects into a main cavity of the specialized cleaning apparatus; closing the specialized cleaning apparatus to prevent jewelry or other small parts from escaping; placing the specialized cleaning apparatus into a machine that provides a turbulent and high velocity cleaning fluid, and allowing the turbulent and high velocity cleaning fluid to impinge upon the jewelry or small parts to be cleaned.

In another embodiment of the method for cleaning jewelry and small parts, a solution such as a detergent, rinsing agent, polishing agent, or other solution that improves the aesthetic appearance of the items to be cleaned is added to the reservoir of said cleaning apparatus. In addition to or as an alternative to this solution, an antimicrobial solution including but not limited to antibiotics, disinfectants, antiseptics, anti-fungal, and anti-viral solutions may be added to the reservoir.

In one embodiment the jewelry attaching devices are secured to the first member or to the second member. Jewelry attaching devices may be, but are not limited to, posts, projections, apertures, hooks, clips, jaws, grippers, enclosed clips, spring clips, bumpers, bars, carabineers, or spools. Attaching devices may be composed of, but are not limited to, materials such as plastic, rubber, urethane, polyurethane, elastomers, metal, silicone, and foam.

In one embodiment, a perforated board and peg system is used to secure jewelry; each peg has one end adapted to be secured to the board, and has a second end adapted to attach jewelry. In some embodiments the peg is roughly cylindrical. In some embodiments the peg attaches to the board via a plunger. In some embodiments, the plunger has a pedestal attaching it to the peg. In another embodiment, the peg has an attached flexible base with diameter greater than the hole in the board that is used to secure the peg.

In another embodiment at least one post projects from a wall of the jewelry cleaner and into the main cavity.

In another embodiment a mesh bag is sized to fit within the main cavity of the small parts cleaner. In one embodiment this mesh bag has an operatively sealable opening that, in some embodiments, is a drawstring, a clasp, an elastic band, a deformable beam, or a tie.

In another embodiment a pair of magnets, one attached to the mesh bag and one attached to the small parts cleaner, secures the mesh bag to the cleaner.

In another embodiment a mechanism to reversibly couple the first member to the second member may include a sliding latch, a locking dial, a threaded screw, a pinch and twist lock, a pinch and slide lock, a sliding rail attachment, a tongue-in-groove fit, a tab and hole lock, an overhanging latch, a magnet, a slide lock, or a push button latch release. In some embodiments, more than one mechanism is used.

In another embodiment the mechanism to reversibly couple the first member and second members is a push button latch release where the latch has a latch notch positioned to fit beneath the frame of the second member. A button connected to the second member has a latch knob that is positioned to displace the latch notch from under said frame when the button is depressed.

In another embodiment the mechanism to reversibly couple the first and second members is a latch bolt with surfaces defining a groove. The latch bolt has a front face with a first end and a second end and a top with a back end. This top is attached to the first end and is oriented approximately perpendicularly to the front face. A bottom with a back end attached to the second end is oriented approximately perpendicularly to the front face; a top projection attached to the back end is oriented approximately perpendicularly to the top, and a bottom projection is attached to the back end and is oriented approximately perpendicularly to the bottom. In one embodiment at least one bolt tongue, a projection from the frame, is sized to fit within the groove defined by the latch bolt.

In one embodiment the bolt tongue is T-shaped.

In one embodiment the latch bolt has surfaces defining at least one gap that is sized to accommodate a tab projecting from the frame of the small parts cleaner.

In one embodiment the latch bolt has at least one finger tab projecting from a surface, and in another embodiment the latch bolt has at least one ridged surface.

In another embodiment a bolt stop is attached to the frame.

In another embodiment the mechanism to reversibly couple the first member to the second member is a latch with an outer surface and an inner surface. A locking projection is attached to the inner surface, and is a roughly L-shaped structure with a first arm and a second arm, where the first arm is oriented perpendicularly to the inner surface, and where the second arm is oriented perpendicularly to the first arm. In one embodiment, a frame has surfaces defining both a locking groove and a gap; the locking groove is sized to accommodate the locking projection, and the gap is a continuous opening between the first member and the second member. In one embodiment, the locking groove has a width greater than the width of the second arm.

In another embodiment the sliding latch fits within a depression formed by the frame. In another embodiment the outer surface of the sliding latch is ridged, and in one embodiment the outer surface of the sliding latch is at least partially covered by a surface with a higher coefficient of friction than the coefficient of friction of the frame.

In another embodiment the latch groove is defined by the frame of the first member and that first member is the top.

In another embodiment the connection between the first and second member is a weak seam, a hinge, a barrel hinge, a cord, a fiber, a frictional fit, a press fitting, or an external securing device.

In another embodiment more than one connection is used to juxtapose first and second members.

In another embodiment at least one spring arm is cantilevered to the frame of the cleaning apparatus. In one embodiment the spring arm includes a tab; the tab is located at the opposite end of the spring arm from the attachment to the frame. In one embodiment the tab is sized to fit within a depression in the frame.

In another embodiment the spring arm includes at least one fastener, hole, projection, or other means for securing jewelry.

In another embodiment the spring arm has a hinge formed with its connection to the frame. In one embodiment the hinge is a seam across substantially the length of the attachment to the frame.

In another embodiment, the small parts cleaning apparatus has a frame with at least two sections, a mesh enclosure attached to the frame and forming an approximately hemispherical housing, and a fastener capable of operatively coupling the at least two sections of the frame. In one embodiment this fastener is a threaded screw closure.

In another embodiment the approximately hemispherical housing contains a jewelry fastening means. In one embodiment, this jewelry fastening means is an internal compartment with a hollow enclosure attached to the frame.

In another embodiment a tether is attached to the small parts cleaning apparatus. In one embodiment a tether attachment is adapted to both be secured to an automatic dishwasher, and to allow a tether to be secured to it.

In another embodiment the small parts cleaning apparatus is a frame with at least two sections, a mesh enclosure forming an approximately cylindrical housing that is connected to the frame, and a fastener capable of operatively coupling the at least two sections of frame together.

In one embodiment the mesh enclosure forms an approximately hemispherical surface on at least one end. In another embodiment the fastener includes a threaded screw closure.

In another embodiment the fastener includes a two-step latch release. In one embodiment the two-step latch release is configured to provide an auditory cue when the two frame sections are fastened.

In another embodiment the small parts cleaning apparatus has a frame comprising at least two sections that are slidingly connected, a mesh covering connected to the frame, and a fastener that is capable of operatively coupling the at least two sections of the frame.

In one embodiment the sliding connection is a tongue-in-groove, a frictional fit, a mitre joint, a bevel, or a dove tail connection. In another embodiment the sliding connection extends essentially the length of the frame.

In another embodiment a rack holder is attached to the frame.

In another embodiment at least one of the frame sections is substantially shaped as a cylindania. In another embodiment the mesh covering of the small parts cleaner is substantially a cylindania that is sized to fit within the cylindania of at least one of the frame sections.

In another embodiment the cleaning apparatus is essentially a rectangle comprised of two sections; each of the two sections contributes three walls to the formation of the rectangle.

In another embodiment the fastener reversibly coupling the first and second members is a sliding latch, a pinch latch, or a push button latch.

In another embodiment the width of the cleaning apparatus is sized to fit between a row of tines on a standard, automatic dishwasher rack.

In another embodiment the cleaning apparatus has walls defining a groove. In one embodiment the groove is sized to accommodate projections from a dishwasher rack.

In another embodiment one of the frame sections fits substantially within the mesh covering. In one embodiment, this mesh covering is constructed from a relatively rigid material which may be metal, plastic, elastomer, or stainless steel.

In another embodiment at least one of the frame sections has a post sized to fit within a ring or other enveloping structure. In one embodiment the ring or other enveloping structure is located on a frame section other than the frame section that includes the post. In another embodiment a stop is located on the post and has a diameter greater than the internal diameter of the ring or other enveloping structure.

In another embodiment the small parts cleaner has a frame with at least two sections that are operatively connected, a mesh covering that is connected to the frame and that forms at least one cone-shaped projection, and a fastener that is capable of operatively coupling the at least two sections of said frame together. In one embodiment at least one cone-shaped projection has a vertex substantially adjacent to the mesh covering of other frame section.

In another embodiment an insert is sized to fit within a cavity of the cleaning apparatus. In one embodiment this insert has at least one cone-shaped projection.

In another embodiment the small parts cleaning apparatus has a top half comprised of a frame supporting a mesh covering. The frame and mesh covering together define a top cavity. A bottom half is similarly comprised of a frame supporting a mesh covering; this bottom is sized to fit within the top cavity.

In one embodiment the cleaning apparatus includes a fastener capable of operatively coupling the top and the bottom halves. In one embodiment this fastener is a tab latch, a latch, a slide lock, a tab lock, or other securing means.

In another embodiment at least one external hook is connected to the frame. In one embodiment this hook is adapted to secure the cleaning apparatus to a dishwasher rack.

In another embodiment both top and said bottom are frustum-shaped.

In another embodiment both top and bottom are connected by a hinge.

In another embodiment both top and bottom are operatively connected by a latch, a lock, a fastener, a slide lock, by friction, or by some other securing means.

In another embodiment a chamber is formed between a horizontal face of the top half and a horizontal face of the bottom half when both halves are in the fully closed position. In one embodiment the horizontal face of the bottom includes at least one aperture, channel, depression, or other fluid directing means.

In another embodiment the small parts cleaning apparatus includes a secondary chamber that is adapted to contain a chemical agent. At least one passage is in fluid connection with the secondary chamber and is thereby capable of conducting the chemical agent. In one embodiment this passage is a channel, trough, pipe, gutter, depression, tube, bore, cavity, duct, groove, hole, passage, orifice, notch, hollow, slit, or other hollow structure.

In one embodiment a passage is positioned to preferentially deliver a chemical agent from a secondary chamber to a main chamber.

In another embodiment a secondary chamber is removably attachable to the small parts cleaning apparatus. In one embodiment the secondary chamber is an autonomous object sized to fit inside a compartment within the cleaning apparatus.

In one embodiment the autonomous object is secured to the small parts cleaning apparatus by magnetic attraction.

In another embodiment a secondary chamber is accessible by an operatively openable surface. In one embodiment this operatively openable surface is a hinge, a seam, a threaded screw, a tongue-in-groove, a deformable band, a dial, a latch, or a trackway.

In another embodiment a chemical agent is in the physical form of a solid, a liquid, or a gel. In one embodiment the chemical agent is a cleaning agent, a rinsing agent, a disinfecting agent, an anti-microbial solution, an anti-pathogen solution, a dye, or a perfume.

In another embodiment a secondary chamber is an ultrasonic welded bag.

In another embodiment small parts are secured to a cleaning apparatus by a fastening means.

These aspects of the disclosure are not meant to be exclusive and other features, aspects, and advantages of the present disclosure will be readily apparent to those of ordinary skill in the art when read in conjunction with the appended claims and accompanying drawings.

BRIEF DESCRIPTION OF THE DRAWINGS

These and other features and advantages of the present disclosure will be better understood by reading the following detailed description, taken together with the drawings wherein.

DETAILED DESCRIPTION OF EXEMPLARY EMBODIMENTS

Figure 1A:
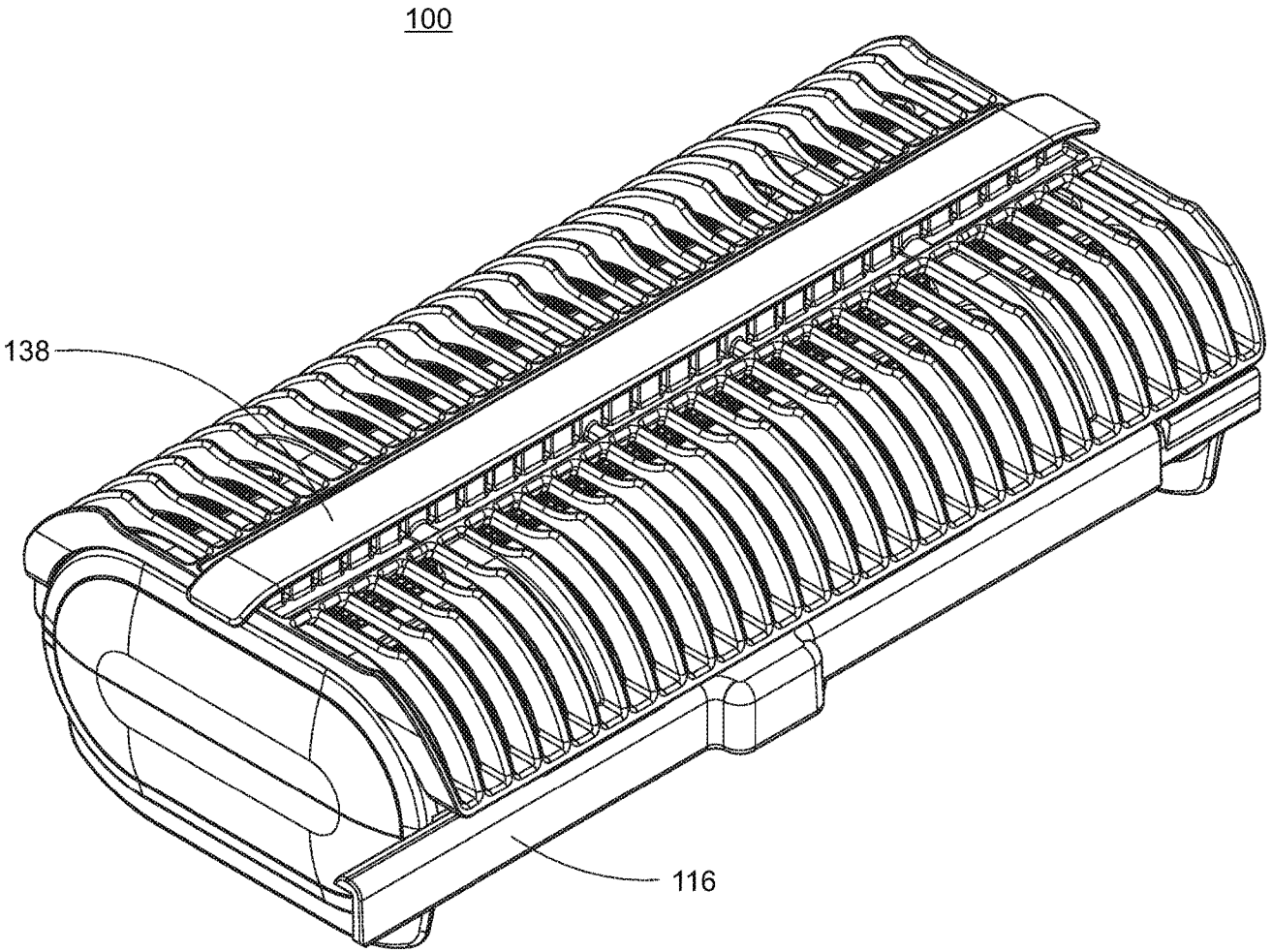
FIG. 1A is a perspective view of one embodiment of a small parts/objects cleaning apparatus.
Figure 1B:
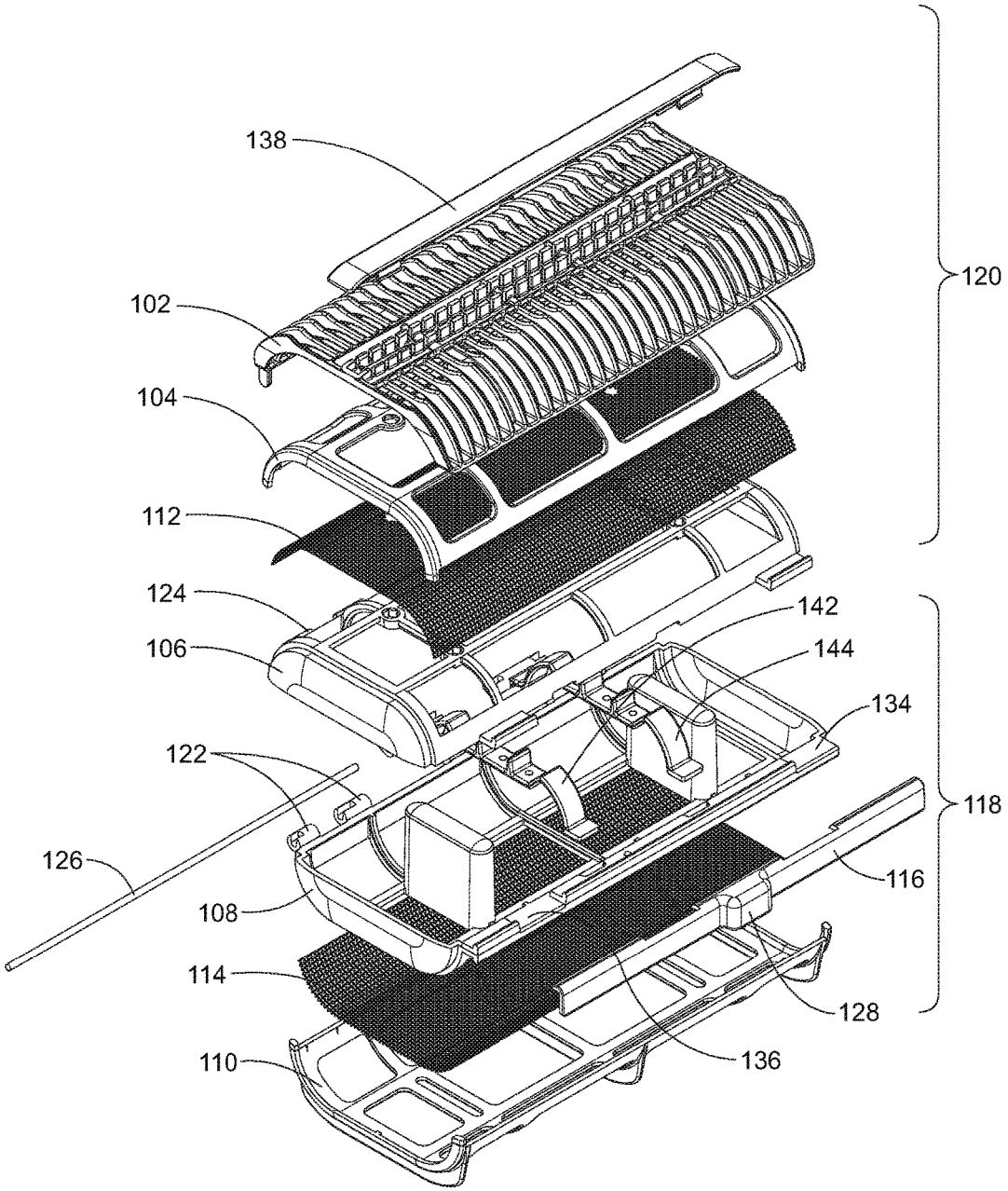
FIG. 1B is an exploded view of the embodiment of a small parts/objects cleaning apparatus shown in FIG. 1A.
Figure 1C:
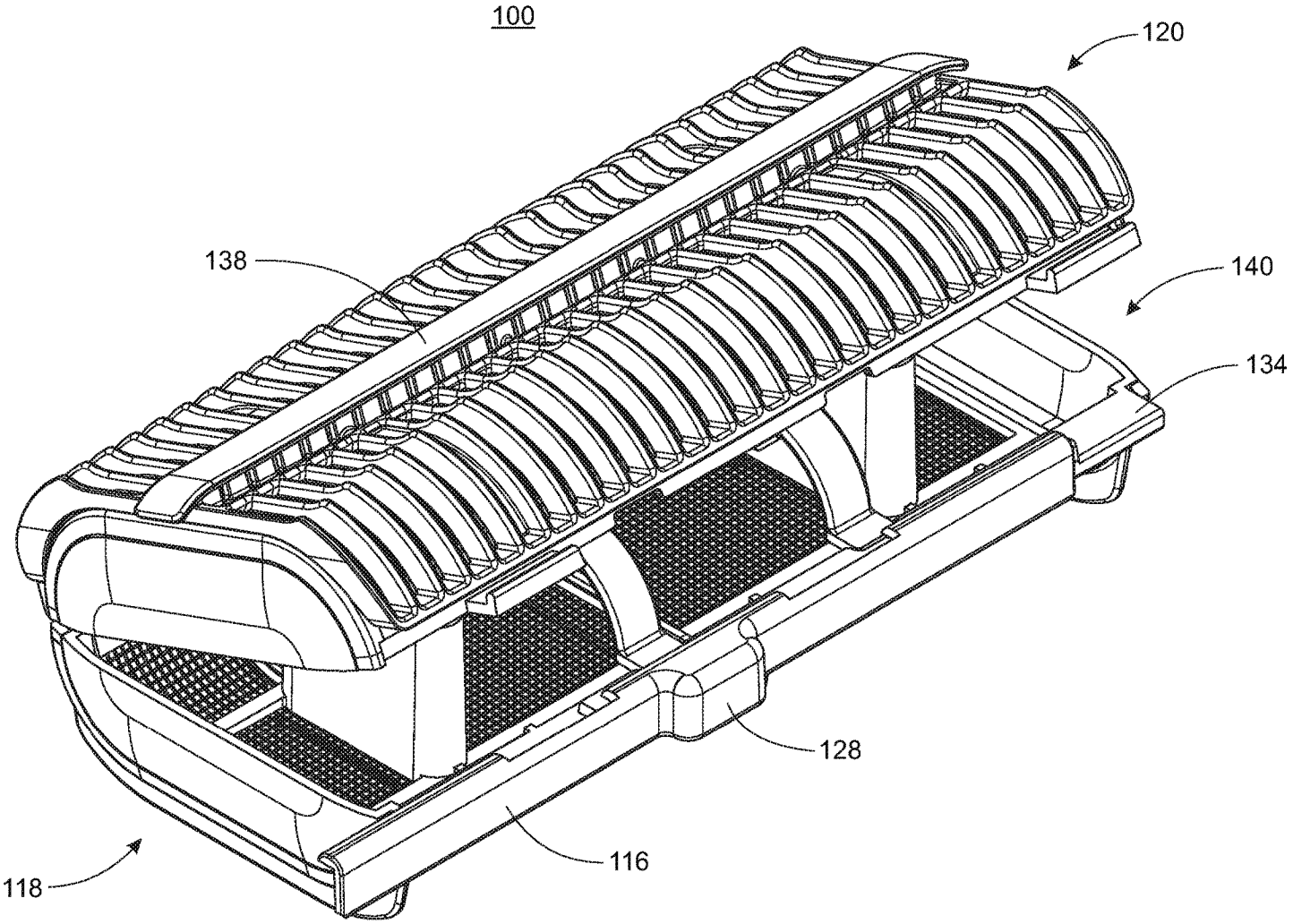
FIG. 1C-1H are various views of one embodiment of the small parts/objects cleaning apparatus shown in FIG. 1A.
Figure 1D:
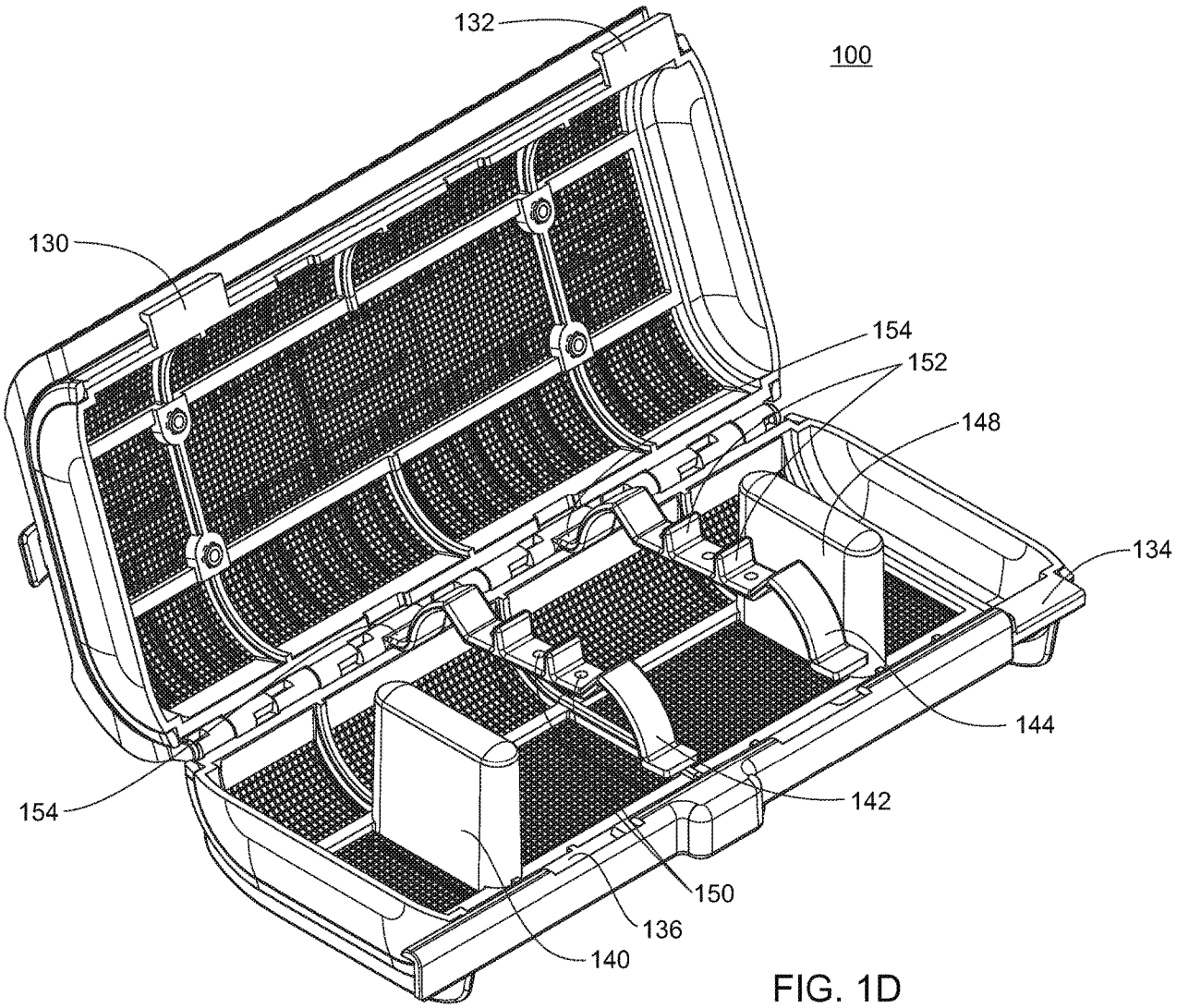
Figure 1E:
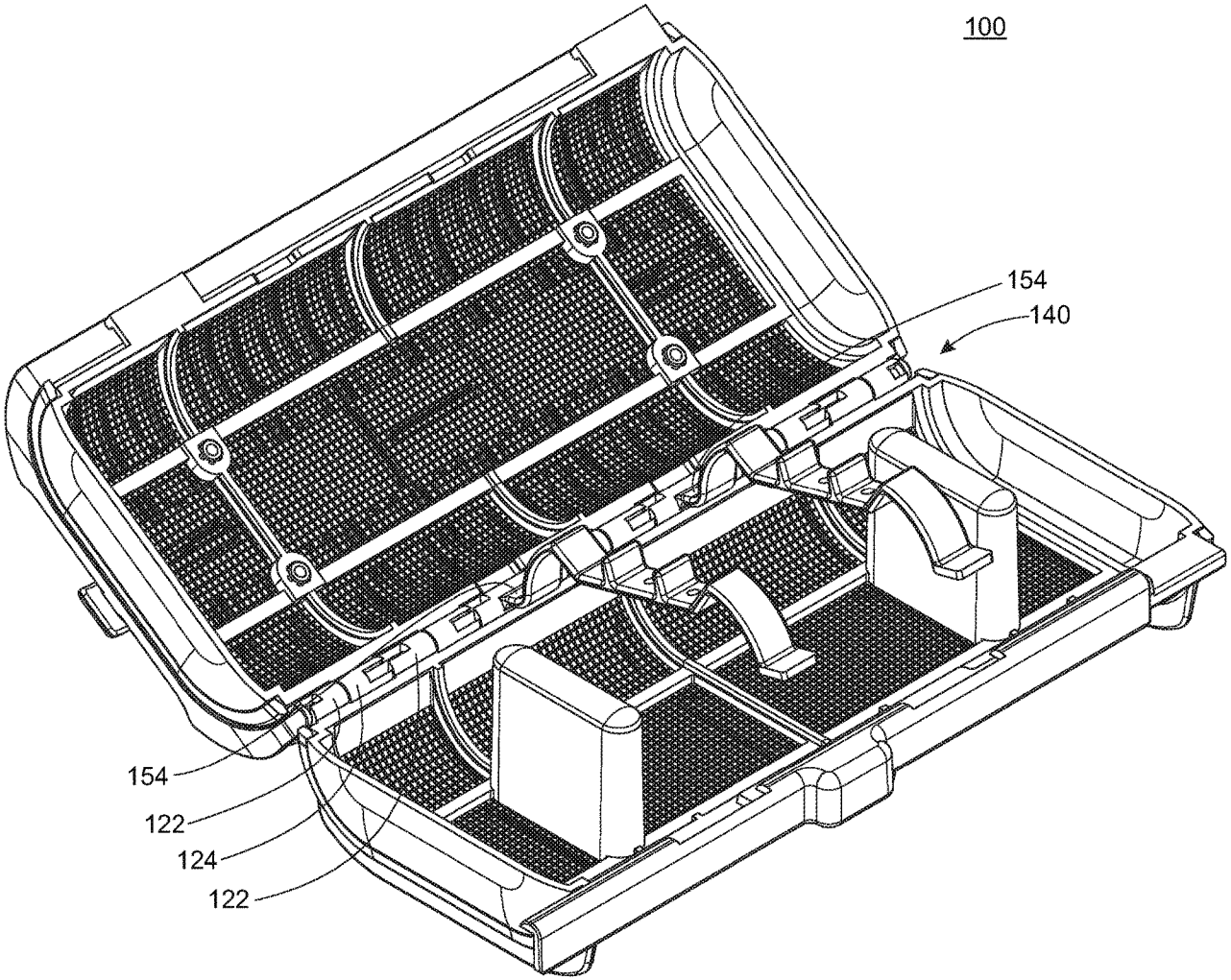
Figure 1F:
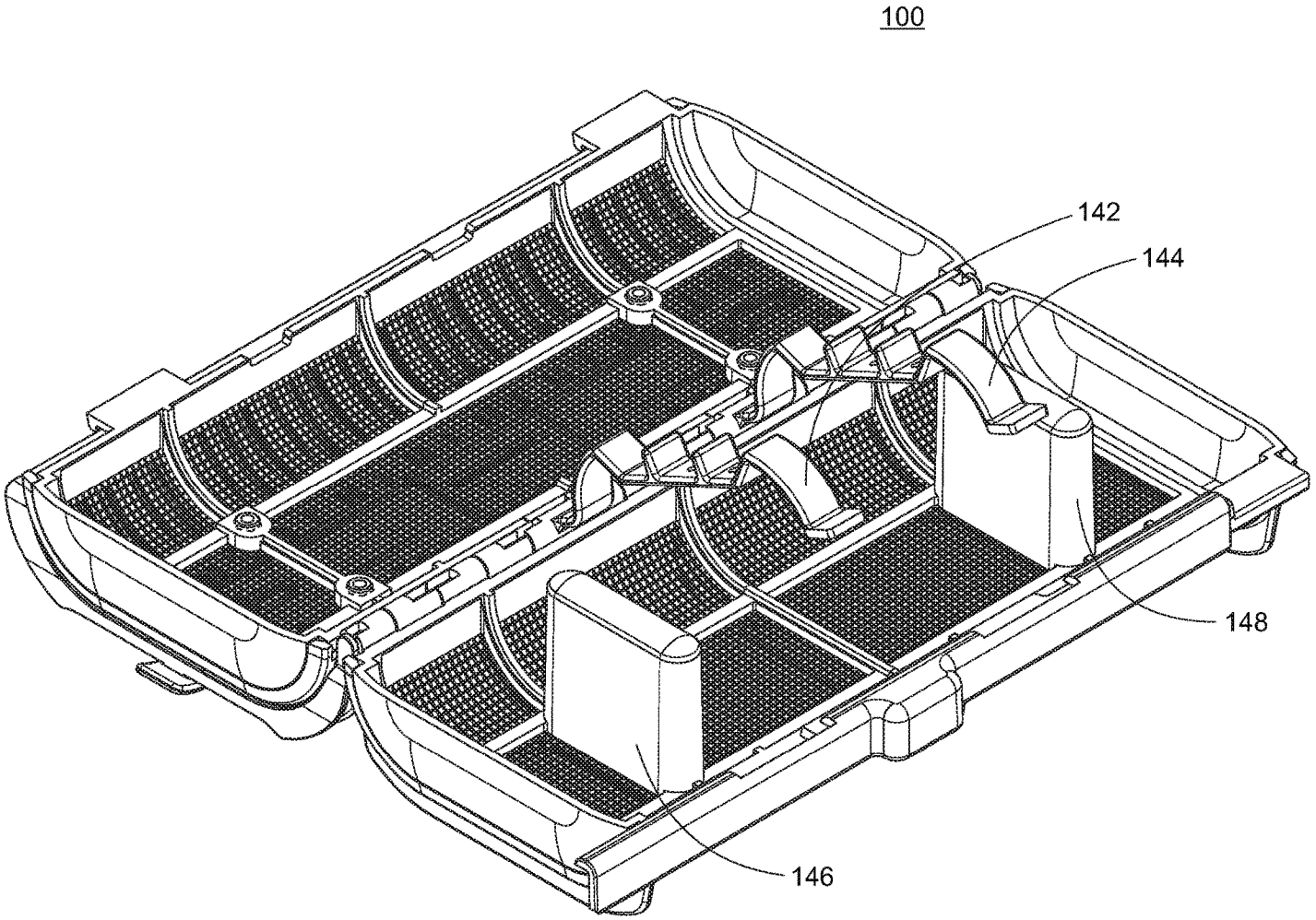
Figure 1G:
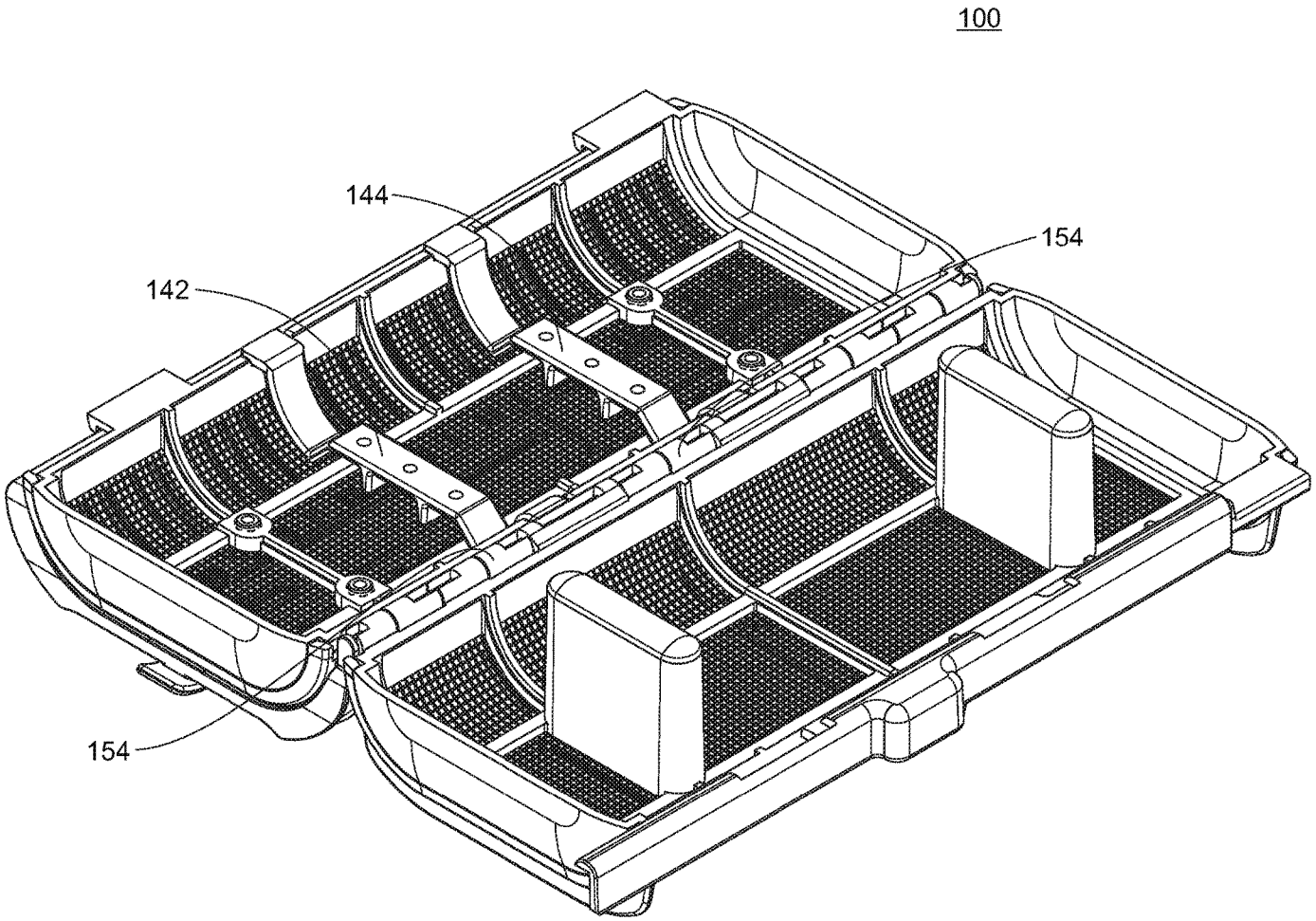

Referring now to FIGS. 1A-1J, an embodiment of the apparatus 100 is shown. In various embodiments, the apparatus 100 includes a frame portion which may include a top portion which may include a top outside portion 102, a top middle portion 104, a top inside portion 106. The frame portion may include a bottom portion which may include a bottom inside portion 108 and a bottom outside portion 110. In various embodiments, the apparatus may include a top mesh portion 112 and a bottom mesh portion 114. In various embodiments, the mesh portions 112, 114 may be sandwiched between the top middle portion and top inside portion and the bottom inside portion and the bottom outside portion, respectively. Thus, in various embodiments, the top middle portion and top inside portion and the bottom inside portion and the bottom outside portion, respectively support the mesh portions 112, 114, respectively.

In various embodiments the frame portions may be made from plastic, and in some embodiments, may be injection molded. In some embodiments, however, the frame may be made from elastomer, polyurethane, urethane, rubber, foam, or other suitably rigid material. In some embodiments, the mesh 112, 114 may be made from plastic mesh and may be heat formed to retain a specified shape or form. In some embodiments, the mesh 112, 114 may be made from stainless steel mesh and may be stamped or otherwise shaped to retain a curvature or form. In some embodiments, the mesh 112, 114 may be injection molded. In some embodiments the mesh 112, 114 may be non-removably attached or configured to be non-removably attached to the frame portions, however, in various embodiments, the mesh 112, 114 may be configured to be removably attached. In some embodiments, the frame and mesh may be configured to be disassembled and the mesh 112, 114 and/or other components of the system may be replaced. The mesh 112, 114 may be beneficial for many reasons, including, but not limited to, the large surface area of open space provided by the mesh 112, 114 arrangement allows a greater volume of cleaning fluid, and at a higher pressure, to enter the inside of the apparatus to act upon the contained small parts/objects, e.g., jewelry. In some embodiments, this may be beneficial for many reasons, including, but not limited to, thorough cleaning of the contained small parts/objects, e.g., jewelry.

In some embodiments the top outer portion 102, top middle portion 104, mesh portion 112, and top inside portion 106 interlock and attach together to form a top portion 120 such that the top include a top middle portion 104 and top mesh portion 112 are sandwiched by to top outside portion 102 and top inside portion 106. In some embodiments, the top outer portion 102, top middle portion 104, mesh portion 112, and top inside portion 106 interlock in a non-removable fashion and in some embodiments, the top outer portion 102, top middle portion 104, mesh portion 112, and top inside portion 106 removabley interlock.

In various embodiments, the bottom inside portion 108, bottom mesh portion 114 and bottom outside portion 110 interlock and attach together to form a bottom potion 118 such that the bottom inside portion 108, and bottom outside portion 110 sandwich the bottom mesh portion 114. In some embodiments the bottom inside portion 108, bottom mesh portion 114 and bottom outside portion 110 interlock in a non-removable fashion and in some embodiments, the bottom inside portion 108, bottom mesh portion 114 and bottom outside portion 110 removabley interlock.

In various embodiments, the top portion 120 hingably attaches to the bottom portion 118 through interlocking bottom hinging features 122 and top hinging features 124. As shown, in some embodiments, the hinging features 122, 124 interlock and a hinging dowel 126 slides within the between the interlocked hinging features 122, 124 to maintain the interlocked hinging features 122, 124 in an interlocked position, for example, as shown in FIGS. 1D-1H.

Figure 1H:
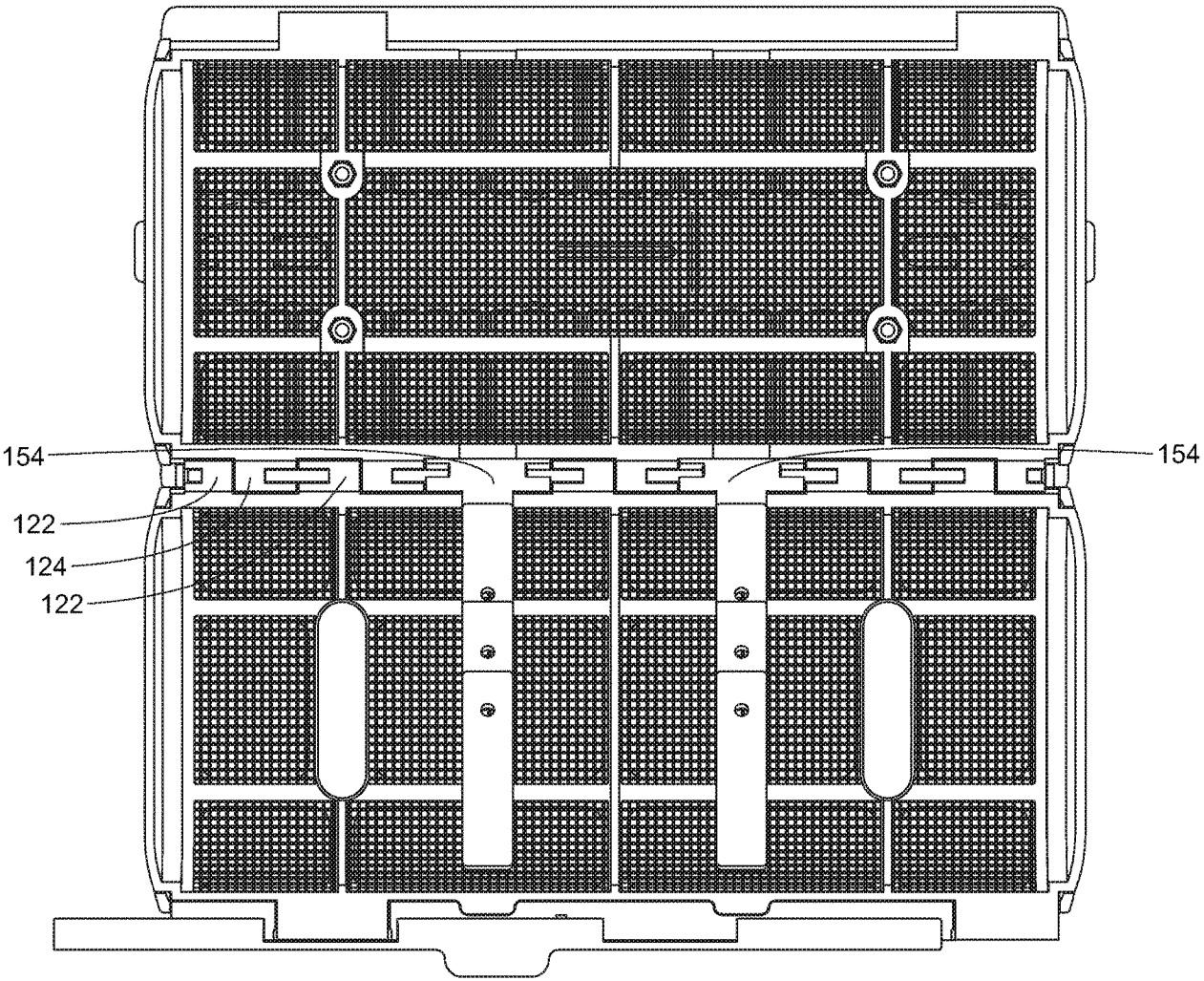
Figure 1I:
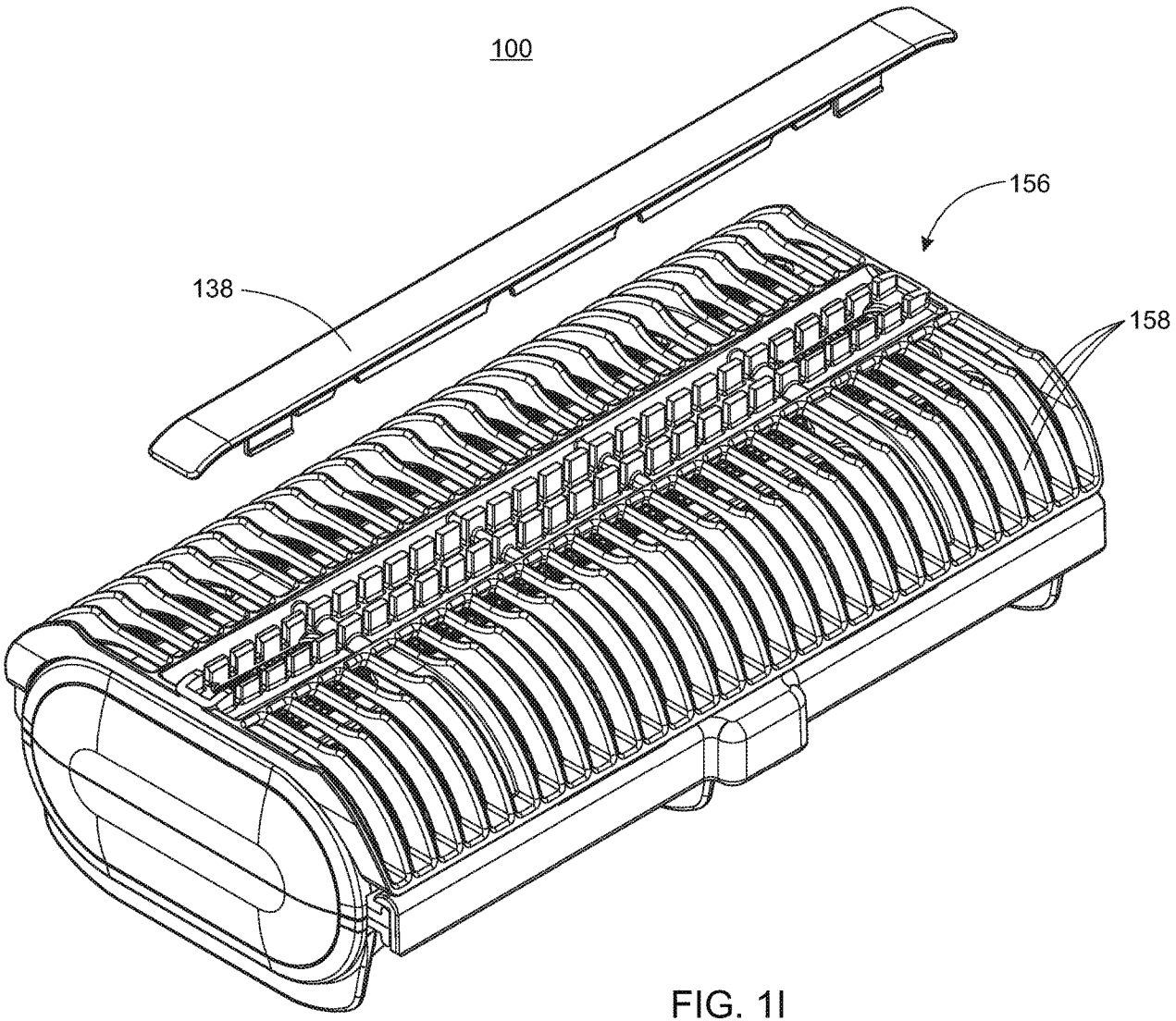
FIG. 1I is a partially exploded view of one embodiment of the small parts/objects cleaning apparatus shown in FIG. 1A.
Figure 1J:
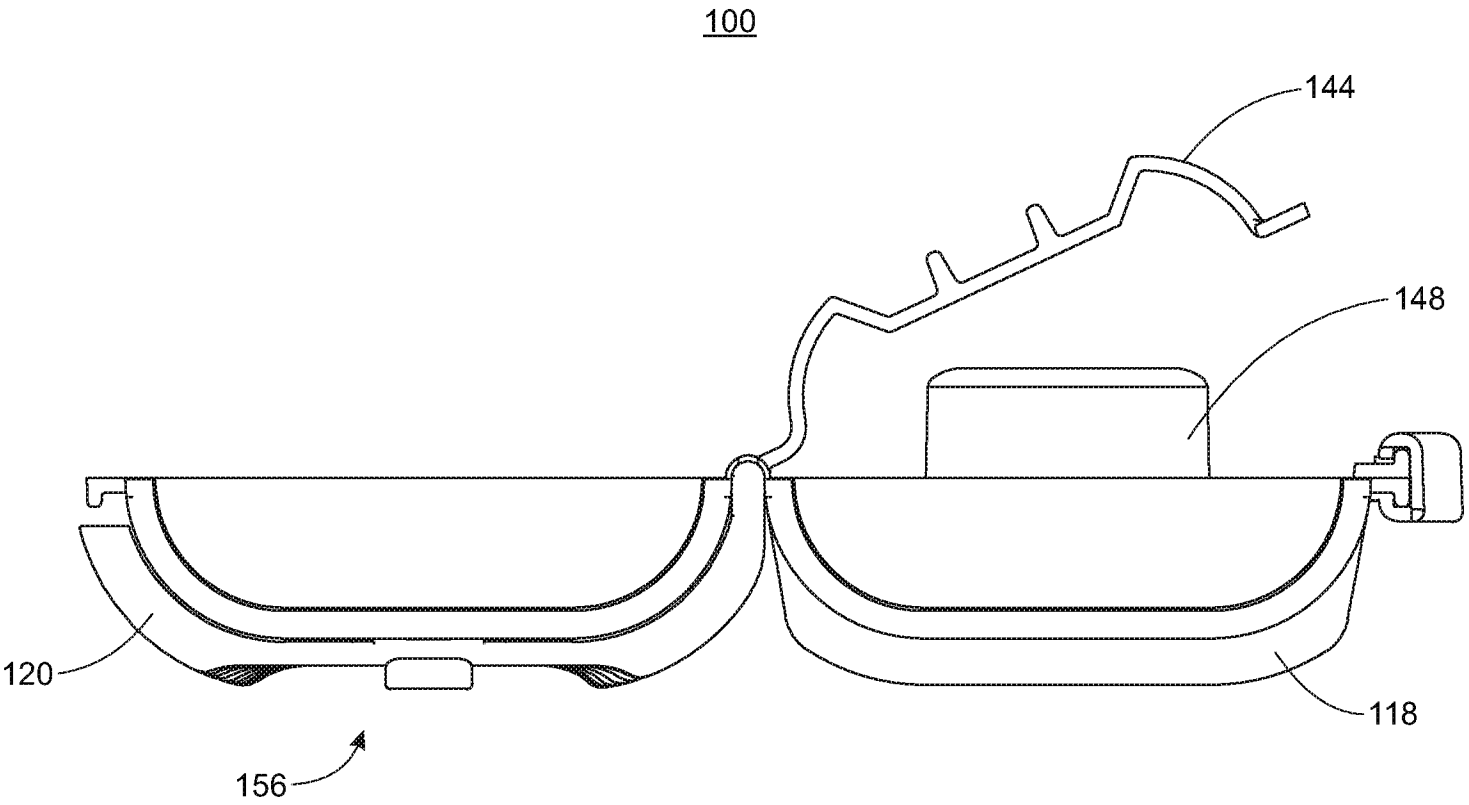
FIG. 1J is a cross sectional view of one embodiment of the small parts/objects cleaning apparatus shown in FIG. 1H.

Referring still to FIGS. 1A-1J, in various embodiments, the top portion 120 and bottom portion 118, may move towards one another to be in a closed position, as shown, for example, in FIG. 1A, and may move away from one another until reaching an open position, for example, as shown in FIG. 1H. The top portion 120 and bottom portion 118 may be partially open and/or partially closed in between the open position and the closed position as shown, for example, in FIGS. 1C-1E.

The top portion 120 and bottom portion 118, while in the closed position, for example, as shown in FIG. 1A, may be latched together such that the top portion 120 and bottom portion 118, remain in the closed position until and unless it is desired that they are in the partially open and/or partially closed and/or open position.

The apparatus may include a latching mechanism/device. In some embodiments, the latch may be a sliding latch, for example, as shown in the embodiment shown in FIGS. 1A-1J. In some embodiments, the sliding latch may include a sliding portion 116 which may include, in some embodiments, a tab 128. In some embodiments, the tab 128 may be configured such that it aids in the sliding of the latch. The top inside portion 106 includes at least one, and in the embodiments shown in FIGS. 1A-1J, at least two latching lock features 130, 132. The latching lock features 130, 132 rest on latching receiving features 134, 136 when the top portion 120 and bottom portion 118 are in the closed position and the sliding portion 116 is in the open position, as shown in FIG. 1A, for example. While the apparatus is in the closed position, and the latching feature in the open position, the sliding portion 116 may be slid such that the sliding portion 116 slides over the latching lock features 130, 132, locking the apparatus in the closed position. While the apparatus is in the closed position (not shown), and the latching feature in the locked position, the sliding portion 116 may be slid in the opposite direction such that the latching receiving features 134, 136 are exposed and the apparatus 100/sliding portion 116 is in the unlocked position.

In some embodiments, one or more of the latching lock features 130, 132 may be textured and or a color such that when the latch is in the unlocked position, a color and/or texture may indicate clearly that the latch is in the unlocked position. When the latch is in the locked position, the color and/or texture is not visible, thereby indicating that the apparatus is locked closed. In various other embodiments of the latching mechanism, color and/or texture may be used to visually indicate to a user that the device is locked and or unlocked. This may be beneficial for many reasons, including, but not limited to, visual indication that the apparatus is locked and closed prior to placing the apparatus in, e.g., a dishwasher, such that the user has assurance that the apparatus cannot unintentionally open while in the dishwasher or other and/or the small parts/objects, e.g., jewelry, will not be lost/fall out of the apparatus.

When the top portion 120 and bottom portion 118 are in the closed position, they form an inner portion 140 of the apparatus. The inner portion 140 is configured to receive and contain the small parts/objects, e.g., jewelry. In some embodiments, the inner portion includes one or more hooking and/or holding mechanisms for the small parts/objects, e.g., jewelry.

Figures 2A, 2B, 2C, 2D, 2E, 2F, 2G, 2H, 2I, 2J, 2K, 2L, 2M, 2N, 2O, 2P:
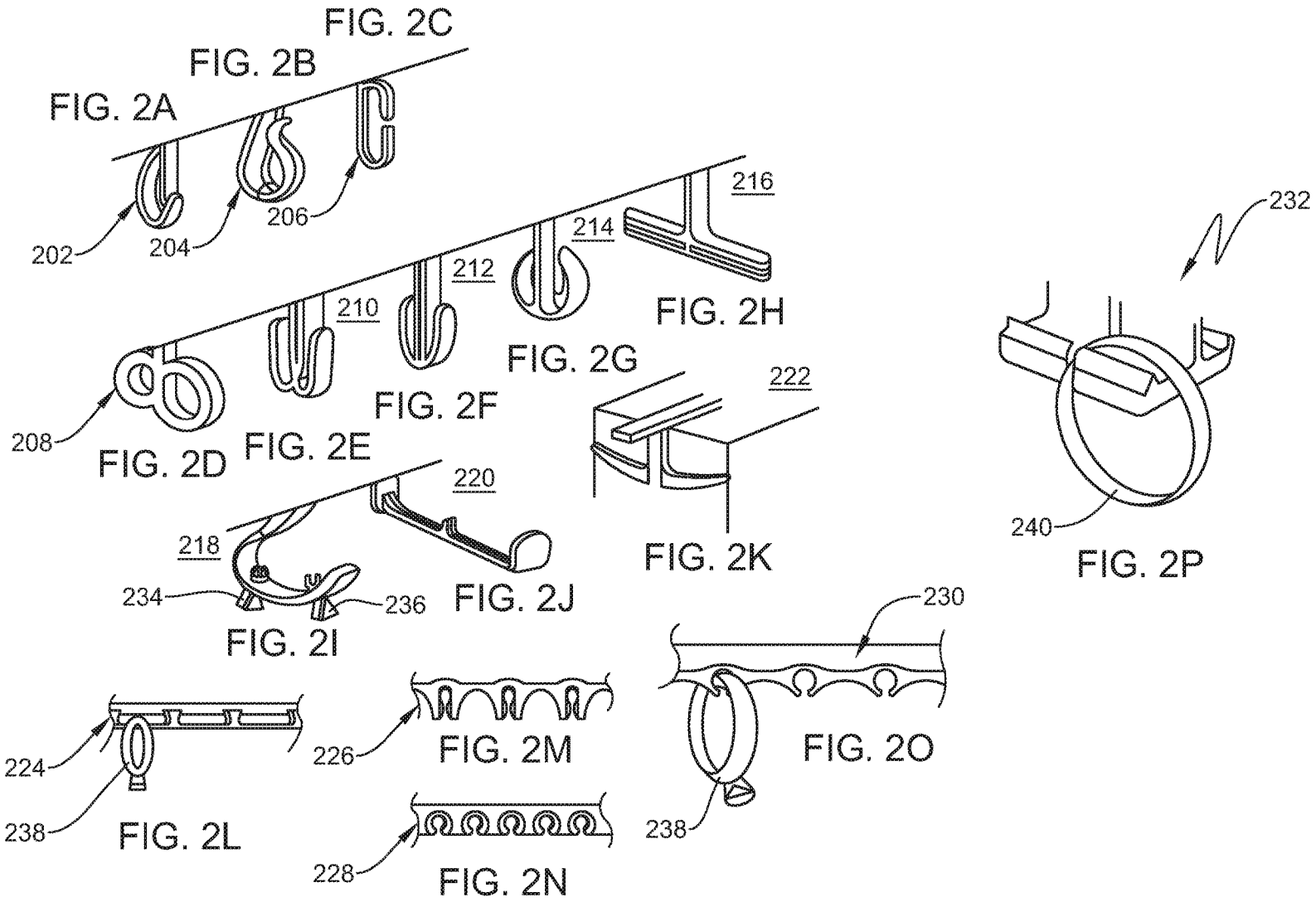
FIGS. 2A-2P are views of various embodiments of hooking and/or holding and/or attachment mechanisms.

Referring now also to FIGS. 2A-2P, the inner portion may include various hooking and/or holding and/or attachment mechanisms (collectively referred to as "attachment mechanisms"), which may include, for example but not limited to, one or more of the following: clips, holder, hooks, holes, protrusions and/or hangers, to maintain the small parts/objects, e.g., jewelry, in place while being cleaned, for example, in a dishwasher. In some embodiments, the apparatus 100 inner portion 140 may include one or more spring holders 142, 144. In some embodiments, the spring holders 142, 144 may include one or more apertures 150 which may be configured to accommodate an earring or other that may be at least partially placed within the aperture and attached to the spring holder 142, 144. In some embodiments, the spring holder 142, 144 may include one or more dividing portions 152 which may be used for holding/maintaining, for example, a ring or circular part in position. In various embodiments, with one dividing portion 152, a ring, for example, may be placed on either side of the dividing portion 152 and during cleaning; the dividing portion 152 maintains the rings in position such that they do not rub against each other or other parts/objects inside the inner portion 140. In some embodiments, the spring holder 142, 144 may be made from plastic and in some embodiments; at least one portion of the spring holder 142, 144 may include a silicone overmold.

In various embodiments, the spring holder 142, 144 may be attached to the bottom hinging features 122 such that, from the closed position, as the top portion 120 moves away from the bottom portion 118, the spring holders 142, 144 move upwards, i.e., lift upwards, away from the bottom mesh 114. Conversely, as the top portion 120 moves towards the bottom portion 118, the spring holders 142, 144 move downwards, i.e., down, towards the bottom mesh 114. This may be desirable for many reasons including but not limited to, one or more of the following: the spring holders 142, 144 may be "loaded" with small parts/objects while the apparatus is in the open position, i.e., while the spring holders 142, 144 up "upward"; while the apparatus is in the open position, the area underneath the spring holders 142, 144 may be "loaded" with other small parts/objects, for example, necklaces/chains or other small parts, such that the loading of these objects is not obstructed by the spring holders 142, 144; and while the apparatus is in the open position, the area underneath the spring holders 142, 144 may be "unloaded", for example, necklaces/chains or other small parts/objects may be unloaded from the apparatus 100, such that the unloading of these objects is not obstructed by the spring holders 142, 144. Thus, in various embodiments, loading the small parts/objects may be less onerous on the user. In various embodiments, the spring holders 142, 144 may be made from plastic. While closing the apparatus 100, the spring holders 142, 144 move downward and the top portion 120 may be locked to the bottom portion 118.

In some embodiments, the spring holders 142, 144 may be attached to the apparatus using a living hinge.

In various embodiments, the apparatus 100 may include one or more protrusions 146, 148. In some embodiments, the protrusions 146, 148 may be used for wrapping chains/necklaces/bracelets around to anchor/maintain those objects in place during cleaning. The protrusions may be used to anchor and/or maintain in place any object and in some embodiments, it may be beneficial to use to the protrusions to maintain relatively larger parts/objects in place, as compared with the spring holders 142, 144 and other attachment mechanisms.

Referring now also to FIGS. 2A-2P, various embodiments of attachment mechanisms are shown. Various embodiments of these attachment mechanisms may be made from plastic and in some embodiments; at least a portion of the attachment mechanism may be overmolded with silicone. In some embodiments of the attachment mechanisms, the attachment mechanism may be entirely overmolded with silicone and in some embodiments, the attachment mechanism may be made from silicone. In other embodiments, the attachment mechanism may be made from any other material, including, but not limited to, metal. Various attachment mechanisms may be attached to the inner portion 140 of the apparatus 100. Various embodiments of the attachment mechanisms may include clips that may be spring clips, for example, attachment mechanisms 202, 204 and 206. Various embodiments of the attachment mechanisms may include enclosed clips, for example, attachment mechanisms 208, 210, 212, 214. In some embodiments, the attachment mechanisms may be a hook, for example, attachment mechanisms 2216, 218, 220, 222. In some embodiments, for example, the embodiment shown in FIG. 2I, the hook attachment mechanism 218 may include apertures to accommodate a small part and/or an object, for example, earring posts of earrings 234, 236. Some embodiments of the attachment mechanism may include a multiple attachment mechanisms, for example, those shown in FIGS. 2L-2O. IN some embodiments, for example, the attachment mechanisms 224, 226, 228, 232, the attachment mechanisms 224, 226, 228, 232 may include a spring "pinch" fastener to accommodate, for example, a ring with a stone 238 or a ring without a stone 240. In these embodiments, the attachment mechanisms 224, 226, 228, 232 may maintain one or more rings 238, 240 next to one another without touching one another, and without touching other objects/small parts in the inner portion 140 during cleaning.

Referring now also to FIGS. 3A-3H, in some embodiments, the attachment mechanism may include a peg board 300 which may be attached to the inner portion 140 of the apparatus 100. The peg board 300 may be beneficial for many reasons including, but not limited to, the ability of the user to customize the location of various attachment mechanisms. The various attachment mechanisms may including, but are not limited to, those shown and described above with respect to FIGS. 1A-1J and 2A-2P, and, in addition, those shown in FIGS. 3A-3I. In various embodiments, the attachment mechanism is attached to a plug 304 that fits within an aperture 302 of the peg board 300. In various embodiments, the plug 304 may be removably attached to the peg board 300.

The attachment mechanisms may include a hook which may be any size desired and may be accommodate, for example, a bracelet and/or a ring. In some embodiments, the attachment mechanism may include a multi-object attachment mechanism 310 which may include attachment mechanisms configured for various sized and/or various types of objections, for example, a bracelet attachment 312 and a ring attachment 314, both which may be a slot with a holding area, the slot used for sliding the object into the holding area, the holding area for maintaining the object in the attachment. The multi-object attachment mechanism 310 in some embodiments may include one or more earring attachment 318, which may include an aperture.

Figure 3A:
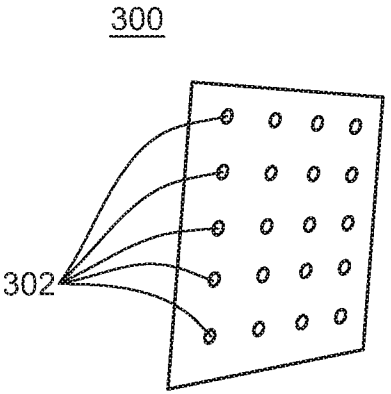
FIG. 3A is view of one embodiment of a peg board.
Figure 3B:
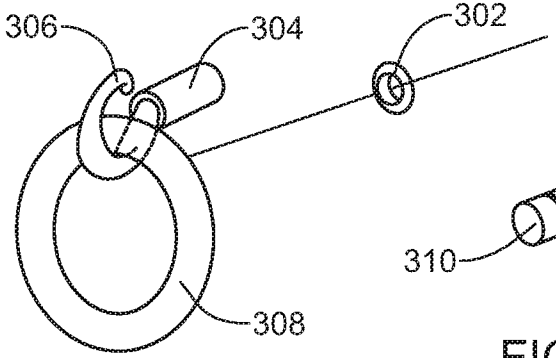
FIG. 3B is a view of one embodiment of an attachment mechanism together with a small part and an aperture.
Figure 3C:
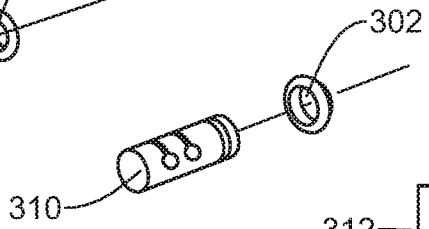
FIG. 3C is a view of one embodiment of an attachment mechanism and an aperture.
Figure 3D:
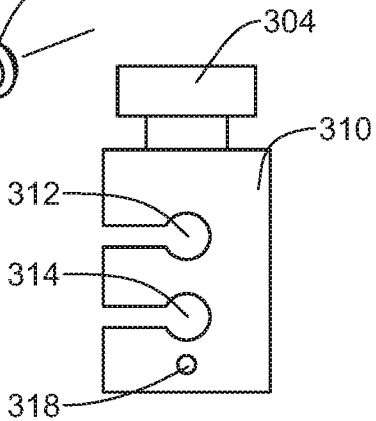
FIG. 3D is another view of the attachment mechanism shown in FIG. 3D.
Figure 3H:
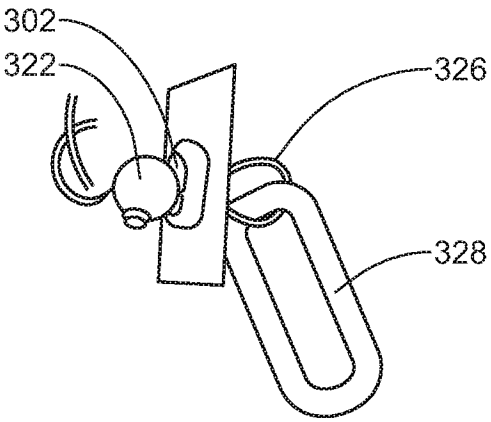
FIG. 3H is a view of one embodiment of an attachment mechanism shown with an aperture.
Figure 3E:
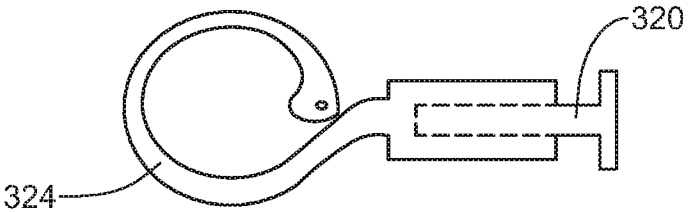
FIG. 3E is a side view of one embodiment of an attachment mechanism with hidden lines.
Figure 3G:
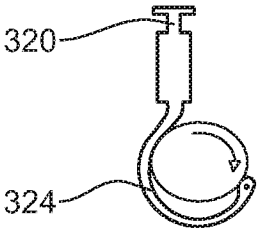
FIG. 3G is another view of the embodiment of the attachment mechanism shown in FIG. 3F, with a small part.
Figure 3F:
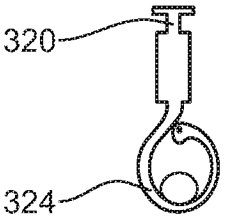
FIG. 3F is another view of the embodiment of the attachment mechanism shown in FIG. 3F, with a small part.

In some embodiments, the plug may include an embodiment including a separatable portion that separates from the attachment mechanism and then reattaches to attach the attachment mechanism to the peg board 300. For example, and as shown in FIGS. 3E-3H as 320 and 322. In some embodiments, the attachment mechanism may include an adjustable hook portion 324 which may adjust to accommodate a variety of sized objected, as shown in FIGS. 3E-3G. In some embodiments, the attachment mechanism may include a wire portion or other flexible portion 326 where the flexible portion 326 is wrapped around the object 328 and then the flexible portion is woven through the aperture 302 of the peg board 300 and attached to a separatable portion 322 to secure the flexible portion 326 attachment mechanism and object 328 to the peg board 300.

In various embodiments, the apparatus 100 may include one or more features for distributing the water and/or cleaning agents and/or for distributed additional agents, for example, rinse agents, from outside the apparatus 100 to the inner portion 140 of the apparatus 100, where the objects/small parts to be cleaned are located. These one or more features may include, but are not limited to, a top reservoir, a shower tray, one or more intakes within the inner portion 140, of the apparatus 100, channels for routing the water and/or cleaning agent and/or rinse agent into the inner portion 140, and/or channeling ducts for routing water and/or cleaning agent and/or rinse agent into the inert portion 140.

Referring still to FIGS. 1A-1J, in various embodiments, the apparatus 100 may include a channeling region 156 where water, as it lands on the apparatus 100, will be at least partially channeled by the multiple fins 158. The fins 158 are located on the top outer portion 102 of the top portion 120 of the apparatus 100. In various embodiments, the fins 158 may aid in directly the water, which may additionally include cleaning agent and/or rinsing agent, to the channeling region 156 of the top outer portion 102. Additionally, the fins 158 may aid in the even distribution of water into the inner portion 140 of the apparatus 100. In various embodiments, the channeling region 156 may include a cover 138 that snaps onto the channeling region 156. The cover 138 may aid in the distribution of water into the inner portion 140. In some embodiments, the apparatus 100 may include an area within or in communication with the channeling region and/or in communication with the water flowing into the inner portion 140, configured to receive one or more agents, which may include, but are not limited to, a rinse agent and/or a cleaning agent. In some embodiments, the cover 138 may be removable and may "cover" the area configured to receive at least one agent. In some embodiments, the cover 138 may not be removable.

Figure 1K:
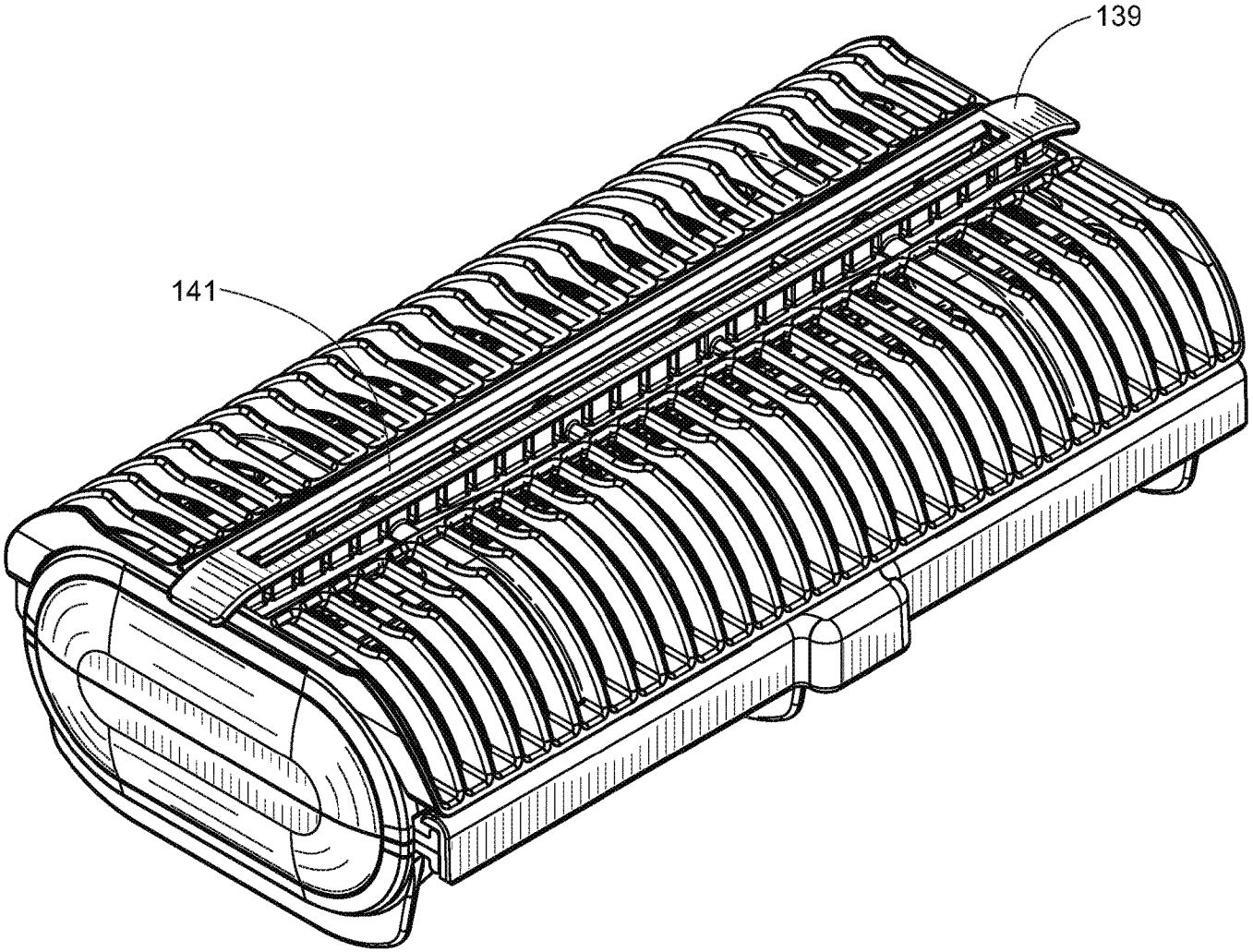
FIG. 1K is a perspective view of one of embodiment of a small parts/objects cleaning apparatus.
Figure 1L:
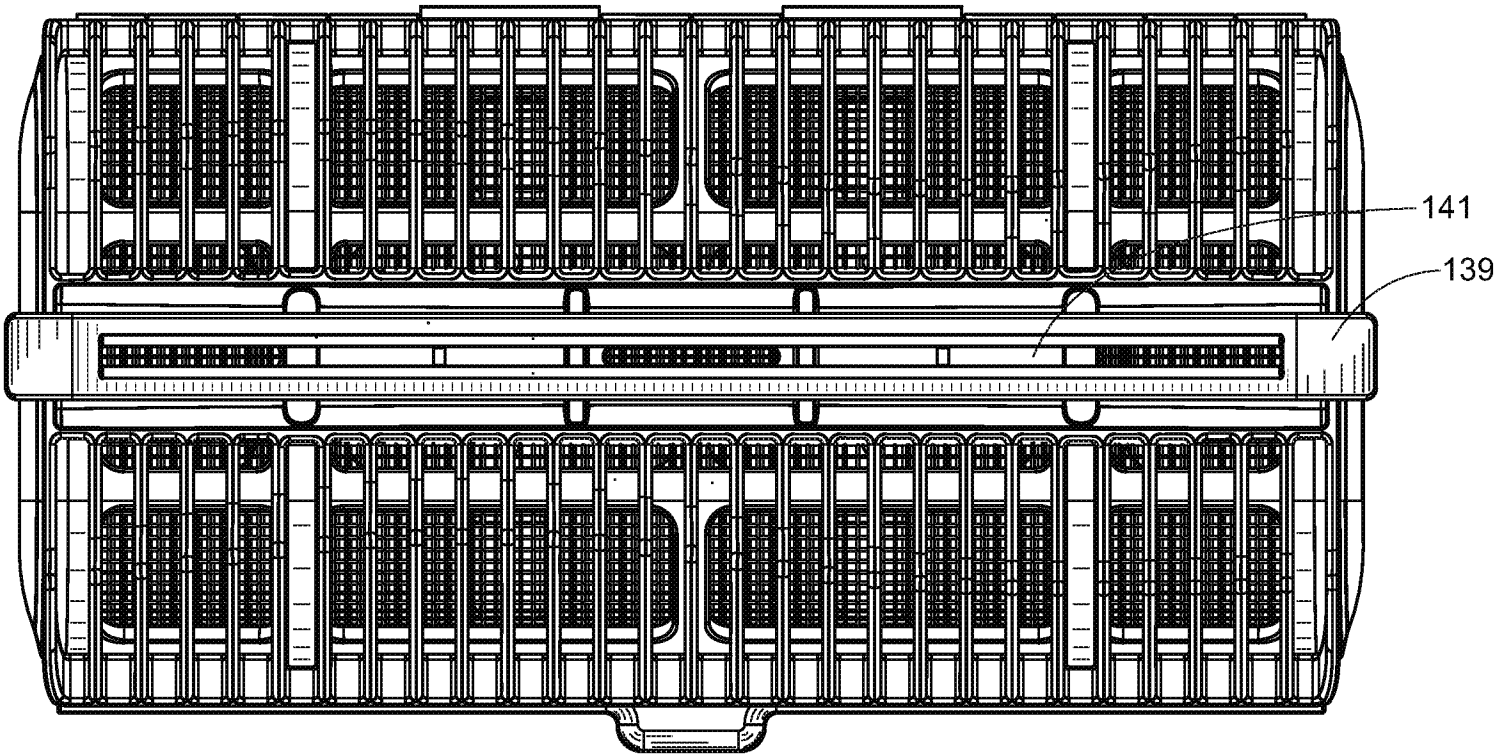
FIG. 1L is a top view of the embodiment of the small parts/objects cleaning apparatus of FIG. 1K.

Referring now to FIGS. 1K and 1L, some embodiments of the cover 139 may include a slot 141 that expands at least a portion of the length of the cover 139. In some embodiments, the slot 141 may be beneficial for many reasons, including but not limited to, increasing the amount of water that flows into the inner portion of the apparatus.

Referring now also to FIGS. 4A-4D, in various embodiments, the cover 402 may be any shape and/or size, for example, the cover 402 may be shaped and/or sized as shown. In some embodiments, the cover 402 may be removably attached such that the cover 402 may be removed to place an agent inside, in an area configured to receive an agent 420, wherein the cover may be reattached. In some embodiments of the various embodiments of the cover 402, the cover 402 may be irremovably attached and in some embodiments, the cover may not "cover" an area configured to receive an agent.

In some embodiments, the area surrounding the cover 402 and/or the area surrounding the area configured to receive the agent may include a top reservoir 406. The top reservoir 406 in various embodiments may be shaped and/or sized differently that shown. The top reservoir 406 may receive water and the water may flow into the area configured to receive the agent 420, which, in some embodiments, may be under the cover 402. In various embodiments, there may be apertures between the top reservoir 406 and the area configured to receive the agent 420. The water then dissolves at least part of the agent and is channeled into the inner portion 408, where one or more small parts and/or objects 422, e.g., jewelry, may be placed. A shower tray 410, in some embodiments, may be included in the inner region 408 attached to, for example, the top inside portion 412. In various embodiments, the shower tray 410 may be sized and/or shaped differently than shown, for example, may be larger or smaller. In various embodiments, the shower tray 410 may include one or more apertures and in some embodiments, a plurality of apertures, in which the water, including from the top reservoir 402, is channeled and dispersed into the inner portion 408. In various embodiments, the plurality of apertures may be formed in a pattern to disperse the water within the inner portion 408 in a target fashion, e.g., targeted to one or more particular areas where small parts/objects are held.

In various embodiments of various embodiments of the apparatus 400, the inner portion 408 may include one or more compartments 414. The compartments 414 may be utilized to hold small parts/objects such that they do not interfere with other small parts/objects held in other locations within the inner portion 408.

In some embodiments, the apparatus 400 may include a channeling shield 404. In various embodiments, the channeling shield 404 may direct water spray that is upward into and down through the mesh portions of the apparatus. For example, as shown in FIG. 4C, the channeling shield 404 channels the water upward and directs the water in and down through the top mesh portion of the apparatus 400, where at least some water is channeled through the shower tray 410.

Figure 4A:
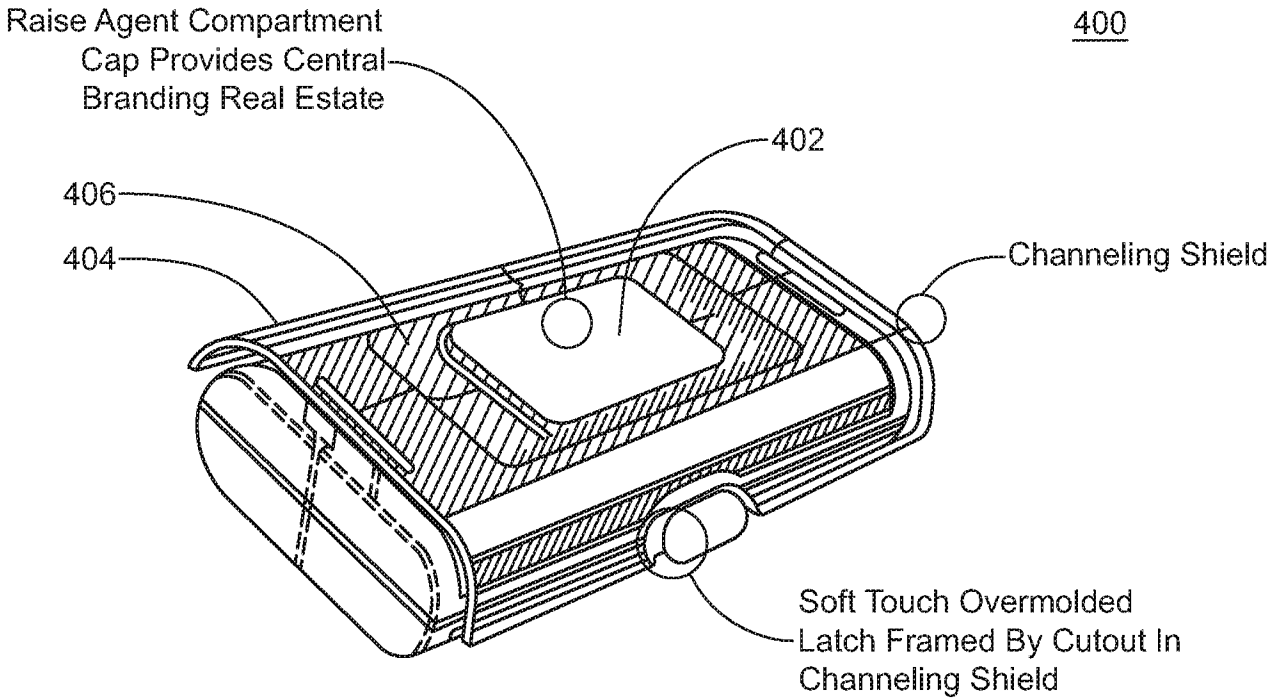
FIG. 4A is a view of an embodiment of an apparatus in the closed position.
Figure 4B:
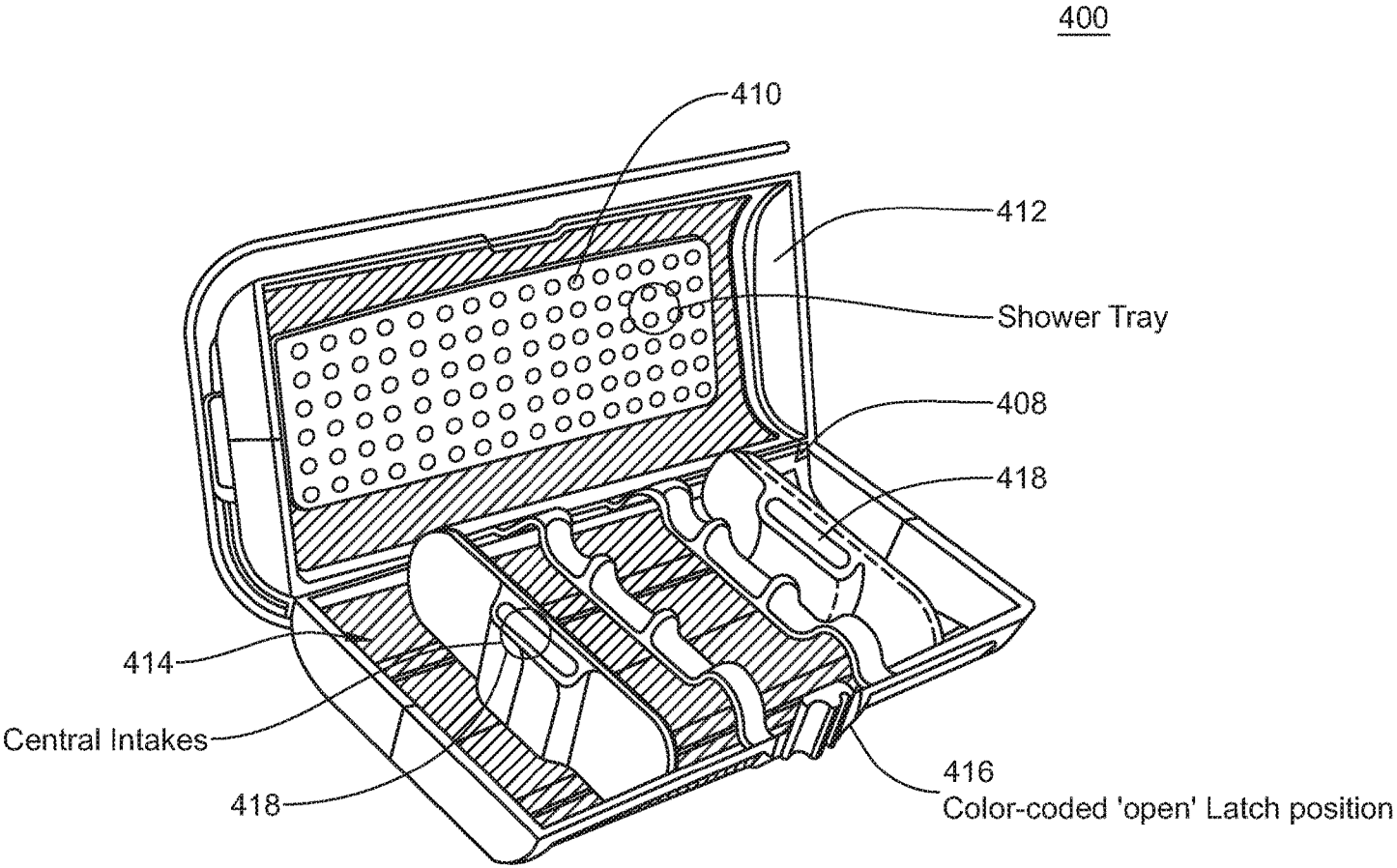
FIG. 4B is a view of an embodiment of the apparatus shown in FIG. 4A in the partially open position.
Figure 4D:
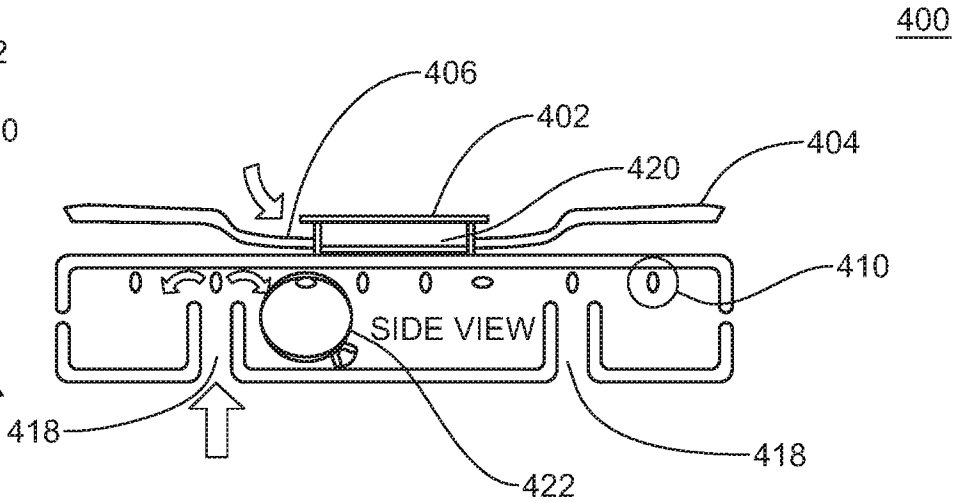
FIG. 4D is an illustrative cross sectional view of the apparatus shown in FIG. 4A.
Figure 4C:
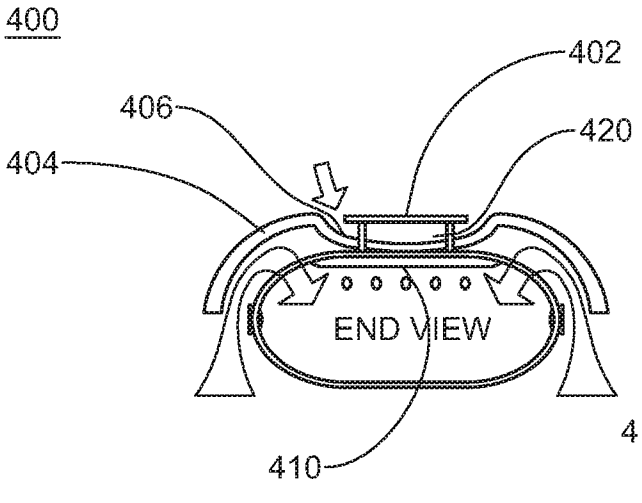
FIG. 4C is an illustrative cross sectional view of the apparatus shown in FIG. 4A.

In various embodiments, the apparatus 400 may include central intakes 418 where water is routed upward, through the central intakes 418, where it sprays inside the inner portion 408, as shown in FIG. 4D. In some embodiments, the central intakes may include a mesh portion which may be beneficial for many reasons, including, but not limited to, maintaining the small parts/objects inside the inner portion 408 and/or ensuring objects are not brought into the inner portion 408 after the apparatus 400 is locked in the closed position.

Figure 5:
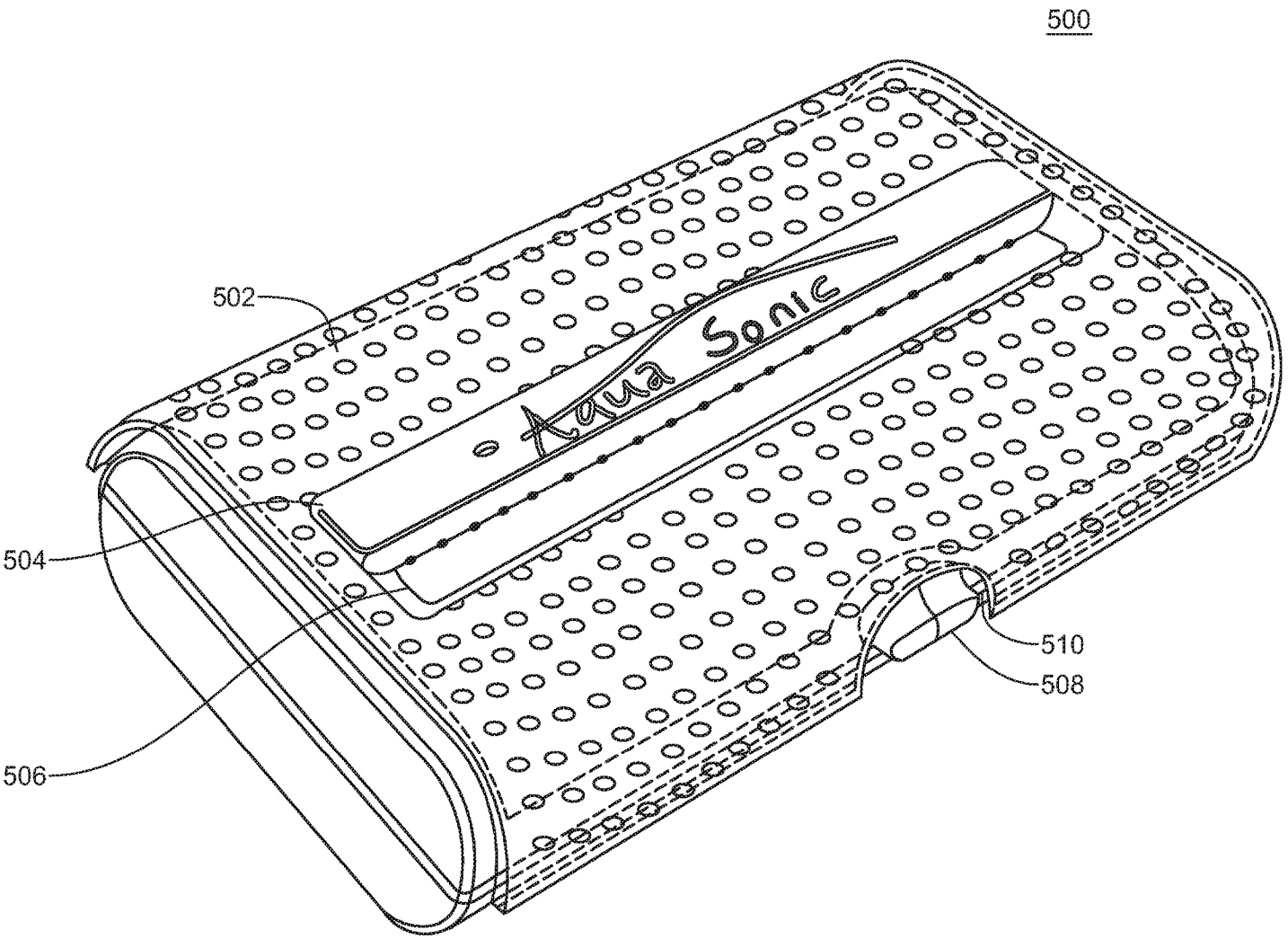
FIG. 5 is a view of an embodiment of an apparatus in the closed position.
Figure 6:
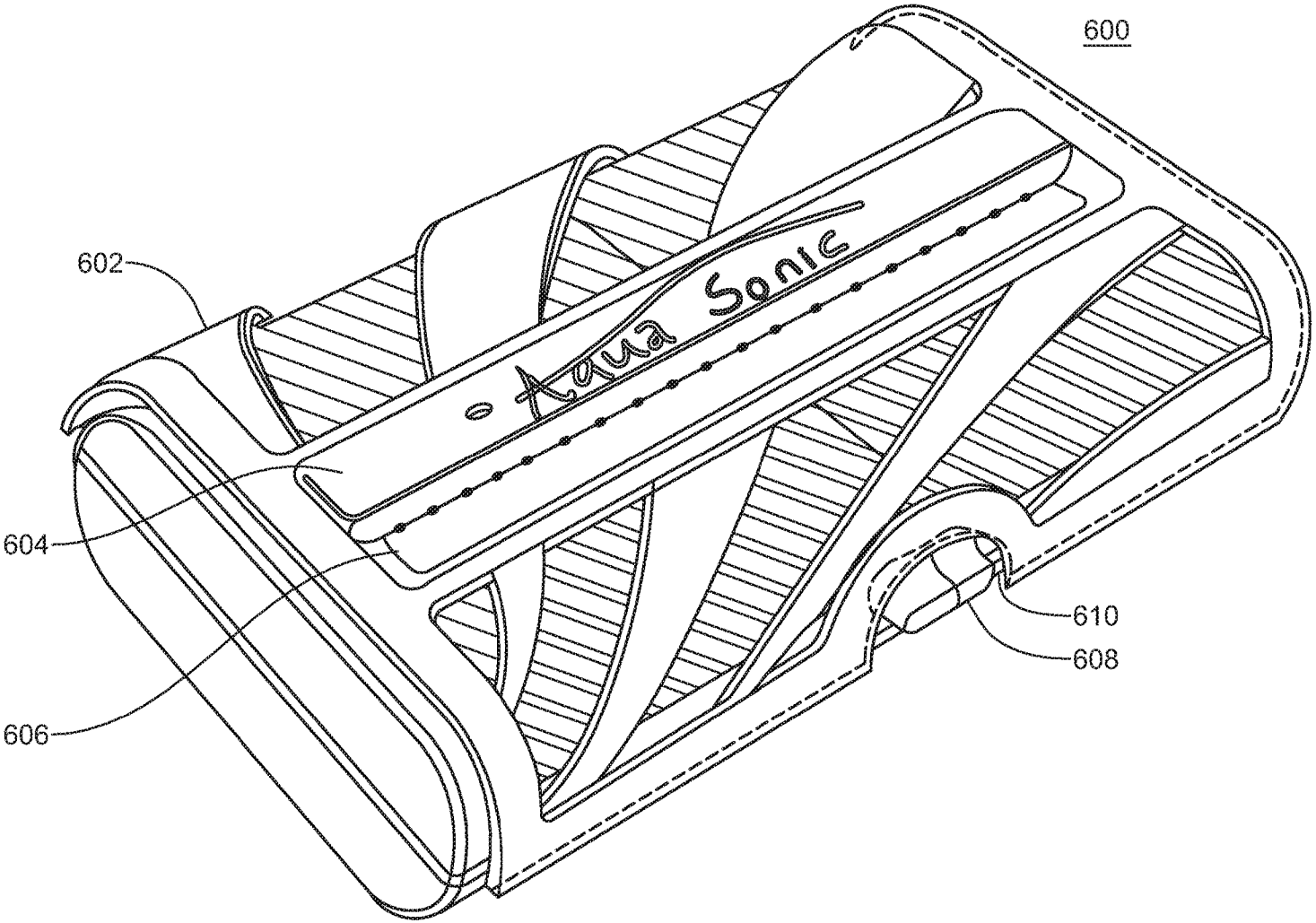
FIG. 6 is a view of an embodiment of an apparatus in the closed position.
Figure 7:
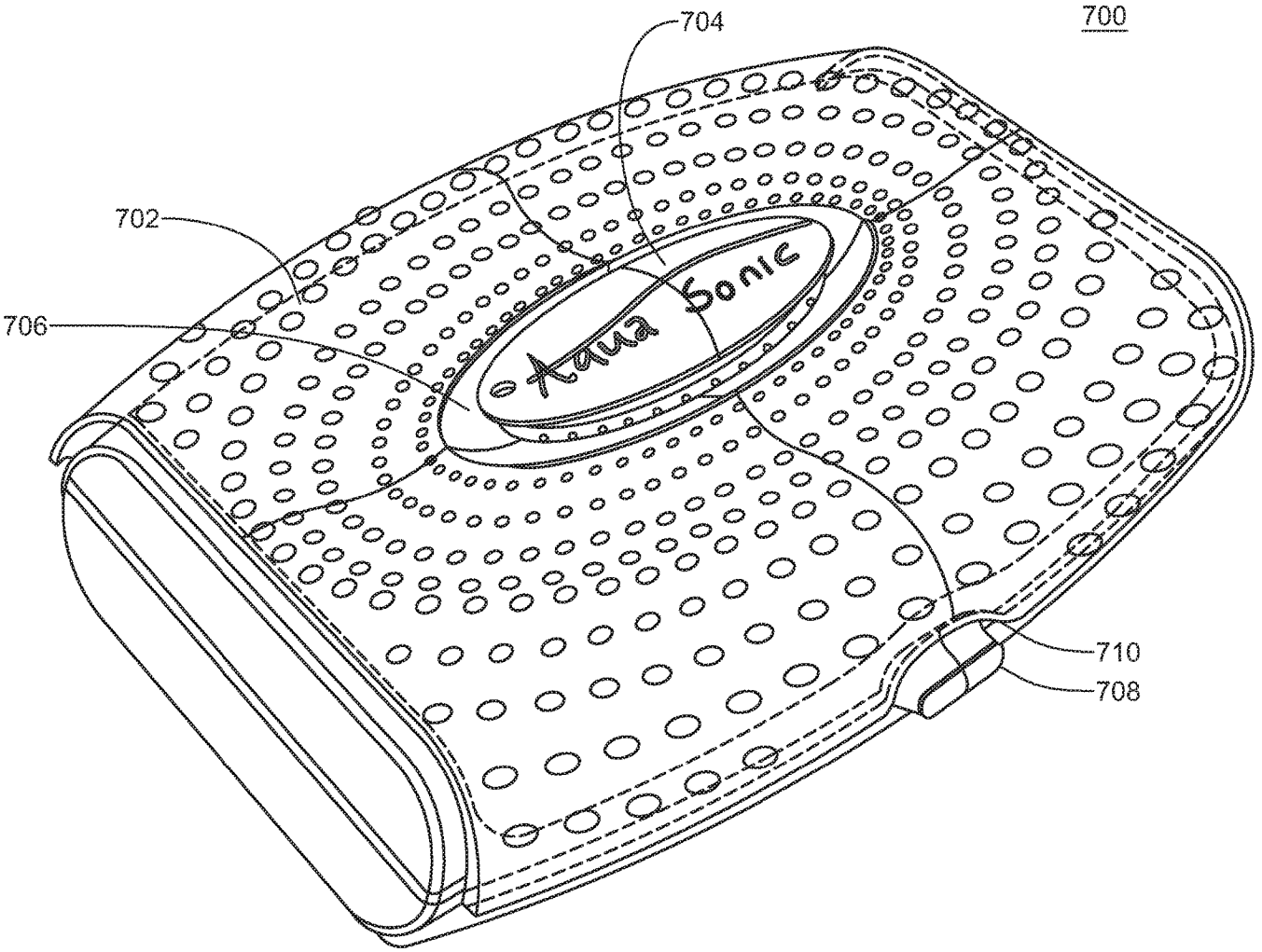
FIG. 7 is a view of an embodiment of an apparatus in the closed position.

In various embodiments, the channeling shield 404 may be shaped and/or sized in various ways. Some embodiments of the channeling shield are shown in FIGS. 5-7. For example, and referring to FIG. 5, in some embodiments, the apparatus 500 may include a channeling shield 502 that may include at least one aperture, and in some embodiments, a plurality of apertures. The apertures may be configured into various patterns, in some embodiments, to target the channeling of the water. In some embodiments, the channeling shield 502 may include a cut-out portion 510 to accommodate a latch 508. As shown, in various embodiments, the shape and/or size of the cover 504 and the top reservoir 506 may vary.

Another embodiment is shown in FIG. 6. In some embodiments, and with reference to FIG. 6, the apparatus 600 may include a channeling shield 602 that may include at least one opening, and in some embodiments, a plurality of opening. The opening may be configured into various patterns, in some embodiments, to target the channeling of the water. In some embodiments, the channeling shield 602 may include a cut-out portion 610 to accommodate a latch 608. As shown, in various embodiments, the shape and/or size of the cover 604 and the top reservoir 606 may vary.

Another embodiment is shown in FIG. 7. In some embodiments, and with reference to FIG. 7, in some embodiments, the apparatus 700 may include a channeling shield 702 that may include at least one aperture, and in some embodiments, a plurality of apertures. The apertures may be configured into various patterns, in some embodiments, to target the channeling of the water. In some embodiments, the channeling shield 702 may include a cut-out portion 710 to accommodate a latch 708. As shown, in various embodiments, the shape and/or size of the cover 704 and the top reservoir 706 may vary.

Figure 8B:
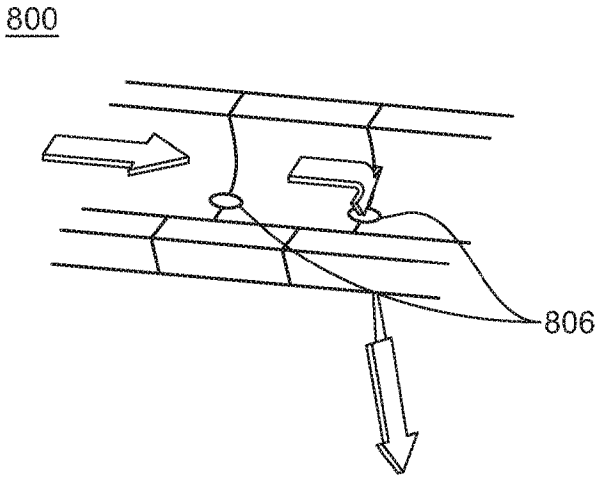
FIG. 8B is an illustrative cut-away magnified view of one embodiment of the channeling ducts shown in FIG. 8A.
Figure 8A:
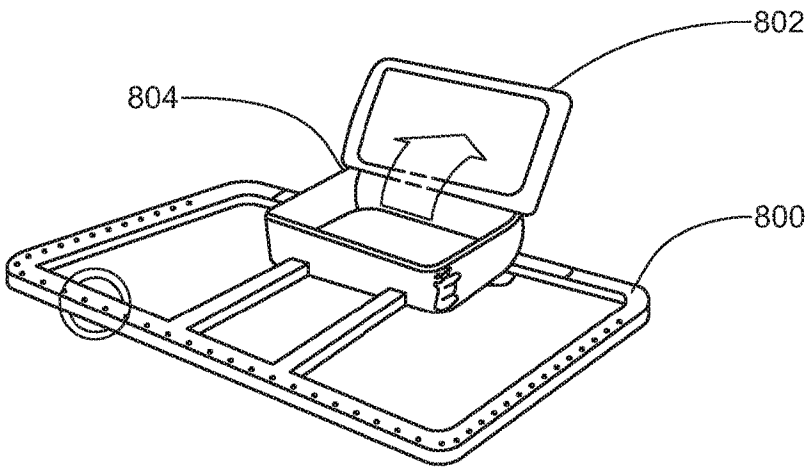
FIG. 8A is an illustrative view of one embodiment of channeling ducts and an area configured to receive an agent, according to one embodiment.
Figure 11:
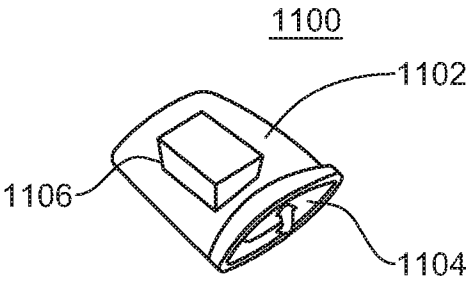
FIG. 11 is a view of an embodiment of an area configured to receive the agent.
Figure 10:
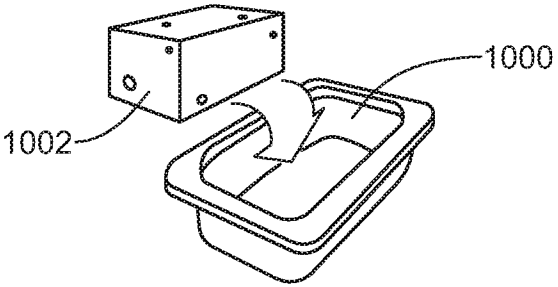
FIG. 10 is a view of an embodiment of an area configured to receive the agent.
Figure 9:
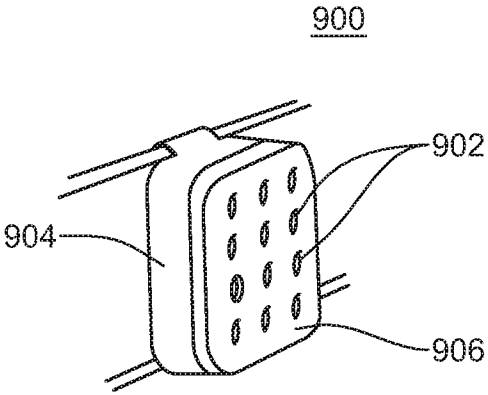
FIG. 9 is a view of an embodiment of an area configured to receive the agent.
Figure 14:
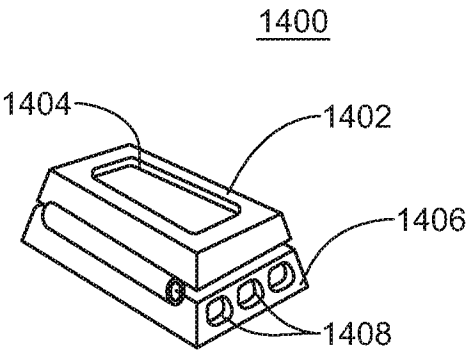
FIG. 14 is a view of an embodiment of an area configured to receive the agent.
Figure 13:
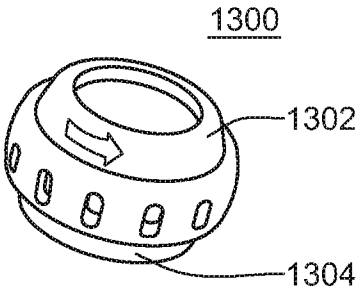
FIG. 13 is a view of an embodiment of an area configured to receive the agent.
Figure 12:
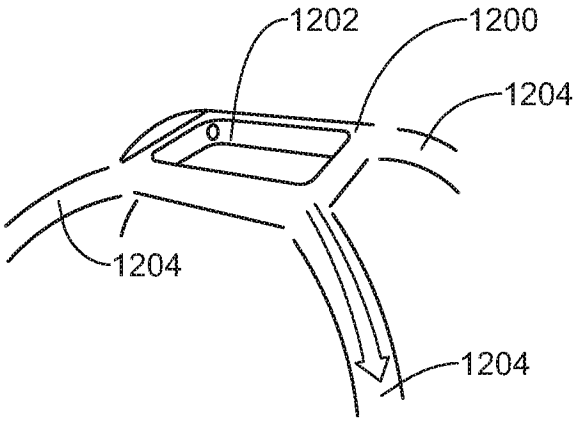
FIG. 12 is a view of an embodiment of an area configured to receive the agent.
Figure 15:
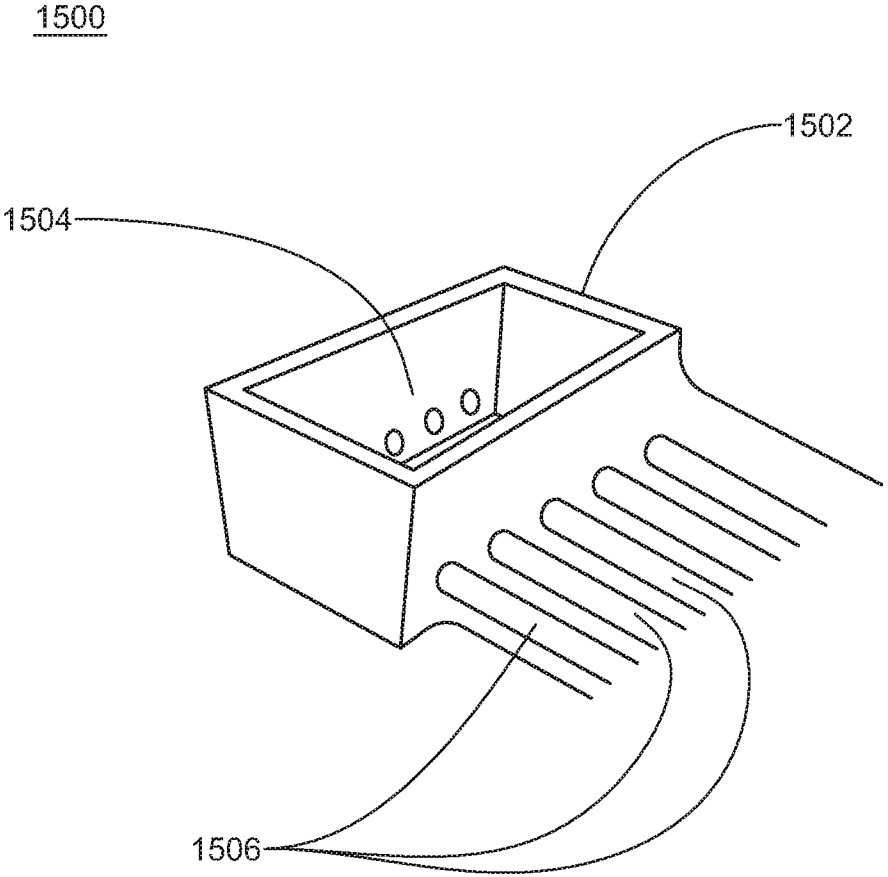
FIG. 15 is a view of an embodiment of an area configured to receive the agent.

Referring also now to FIG. 8A, various embodiments if the apparatus may include channeling ducts 800 which, in some embodiments, may be configured as illustrated. In various embodiments, the path the channeling ducts 800 create may vary and the path shown is for illustrative purposes only. Other paths and/or configurations are contemplated. In various embodiments, the path/configuration of the channeling duct 800 may be configured to deliver water to various locations within the inner portion of the apparatus, for example, to areas that may include small parts/objects for cleaning, e.g., jewelry. In some embodiments, the channeling ducts 800 may be in communication with the area configured to receive the agent 804, which agent may include a rinsing agent and/or a cleaning agent. In various embodiments, the area configured to receive the agent 804 may include a cover 802 which may, in some embodiments, be hingedly attached to the area configured to receive the agent 804. However, in various other embodiments, the cover 802 may be attached in various manners or may be configured differently, for example, may be configured as shown and described herein with respect to various embodiments.

Referring now also to FIG. 8B, a cut-away magnified view of an embodiments of the channeling ducts 800 is shown. The channeling ducts 800 may include one or more apertures 806. In various embodiments, water flows into the area configured to receive the agent 804 and the agent is dissolved by water and the water with the agent dissolved empties into the channeling ducts 800 and is distributed over the inner portion of the apparatus. In some embodiments this configuration may be beneficial for many reasons, including, but not limited to, even or more even distribution of the agent over the various small parts/objects located in the inner portion of the apparatus.

In the various embodiments of apparatus, an area configured to receive an agent may be included and may be built into the apparatus and/or removably attached to the apparatus and/or may be autonomous and configured to be received inside a compartment of the apparatus. In various embodiments, the area configured to receive the agent may be referred to as a "dispenser". In various embodiments, the dispenser may have a hollow compartment for containing the agent, and the compartment may include a cover or other which, in some embodiments, may be removably attached using one of a variety of mechanisms, including, but not limited to, a hinge, seam, threaded screw, tongue-in-groove, deformable band, dial, latch, trackway, or other type of attachment mechanisms. In some embodiments, the dispenser may include at least one aperture to allow water to enter and exit and allow the agent, when dissolved in the water, to permeate into the inner portion of the apparatus. In various embodiments, the dispenser may include channels or other to target the fluid flow to particular areas within the apparatus. In various embodiments, the dispenser may be made from any suitable material, including, but not limited to plastic, mesh, fabric, metal, rubber, nylon, and/or elastomer. Agents may be in any form, including solid, liquid, powder and/or gel. Agents may include, but are not limited to, cleaning agents, rinsing agents, disinfecting agents, antimicrobial solutions, anti-pathogen solutions, dyes, and perfumes.

In various embodiments, the apparatus may include an area configured to receive an agent, as discussed above. The configuration of the area configured to receive the agent may be different from those discussed and shown above. In some embodiments, the area configured to receive the agent may be one or more of the following embodiments. Referring now to FIGS. 9-15, various embodiments of the area configured to receive the agent are shown. In some embodiments area configured to receive the agent 900 may include a housing 904 including a cover 906 that may include one or more openings 902. In some embodiments, the area configured to receive the agent may include a basin 1000 configured for receiving the agent 1002. In some embodiments, the area configured to receive the agent 1100 may include a bag-like housing 1102 that may include a closable opening 1104 on at least one end that is configured to be opened and to receive the agent 1106. In various embodiments, the closable opening 1104 may be a water-tight closure. In some embodiments, the area configured to receive the agent 1200 may be configured to receive an agent 1202 and may be in communication with fluid paths 1204 which distribute the agent 1202. In some embodiments, the area configured to receive the agent 1300 may include a top housing 1302 and a bottom housing 1304 which are rotatably engaged to one another. In some embodiments, the agent is placed inside the bottom hosing 1304 and the top housing 1302 is attached and rotated with respect to the bottom housing 1304, forming a sealing engagement. In some embodiments, the top housing 1302 may include at least one aperture for the agent to be distributed outside of the area configured to receive the agent 1300. In some embodiments, the area configured to receive the agent 1400 may include a bottom housing 1406 and a cover 1402, hingedly attached to the bottom housing 1406. In some embodiments, the cover 1402 may include an opening 1404. In some embodiments, the bottom housing 1406 may include one or more apertures 1408 through which the agent may be distributed. In some embodiments, the area configured to receive the agent 1500 may include a basin 1502 for receiving the agent 1504. The agent 1504 may be distributed through one or more channels 1506.

Referring next also to FIGS. 16-30C, various embodiments of the apparatus are shown. These embodiments are not meant to be limiting, and other embodiments are contemplated.

Figure 16:
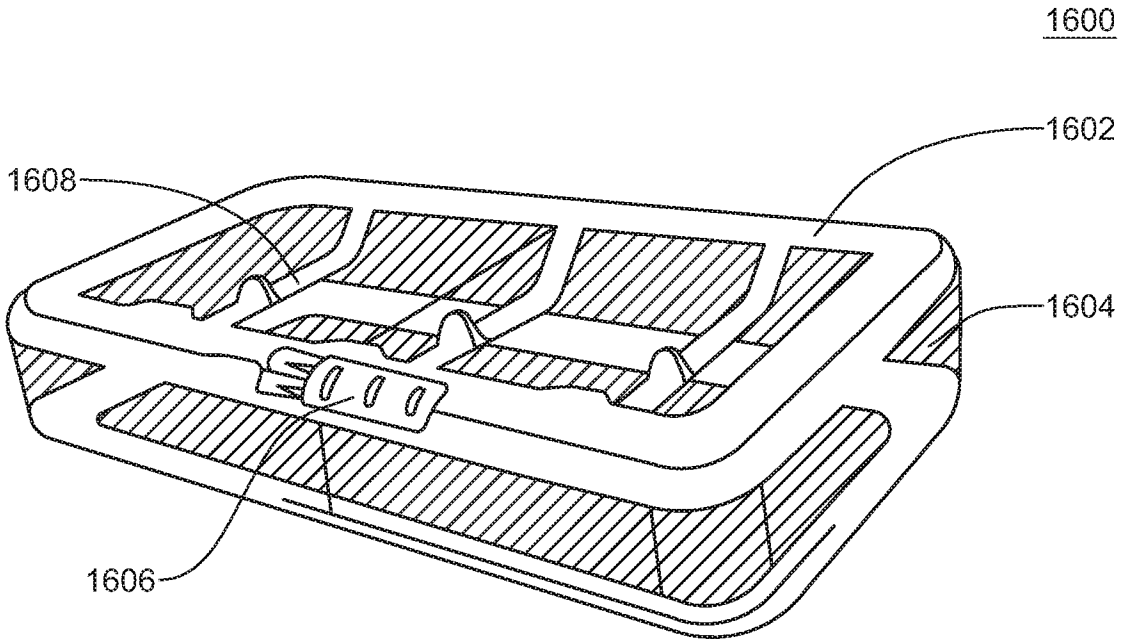
FIG. 16 is a view of an embodiment of an apparatus.

In some embodiments, and referring to FIG. 16, the apparatus 1600 may include a frame portion 1602 and a mesh portion 1604. The apparatus may include one or more sections in the inner portion of the apparatus which may include one or more attachment mechanisms 1608, as discussed and described herein. The apparatus may include a latching mechanism 1606 which may be any type of latching mechanism 1606, including, but not limited to, a sliding latch, an interlocking features latch a pinch and twist latch, a pinch and slide latch and/or a twisting latch. Various features discussed and described above with respect to latching mechanisms may be included in any one or more of the embodiments of the apparatus described herein. There may be many benefits to this configuration of the apparatus 1600 including, but not limited to, the minimal frame portion 1602 structure and large amount of mesh portion 1604 surface area may improve water access to the inner portion of the apparatus 1600. Also, the molding and/or forming mesh in this manner may result in the mesh to being substantially self-supporting, in some embodiments, requiring a less supportive frame.

Figure 17B:
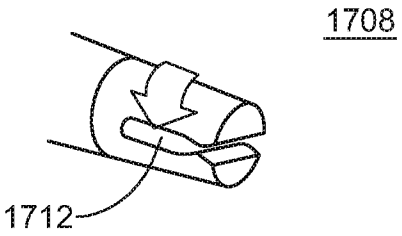
FIG. 17B is a detailed view of an attachment mechanism according to one embodiment.
Figure 17A:
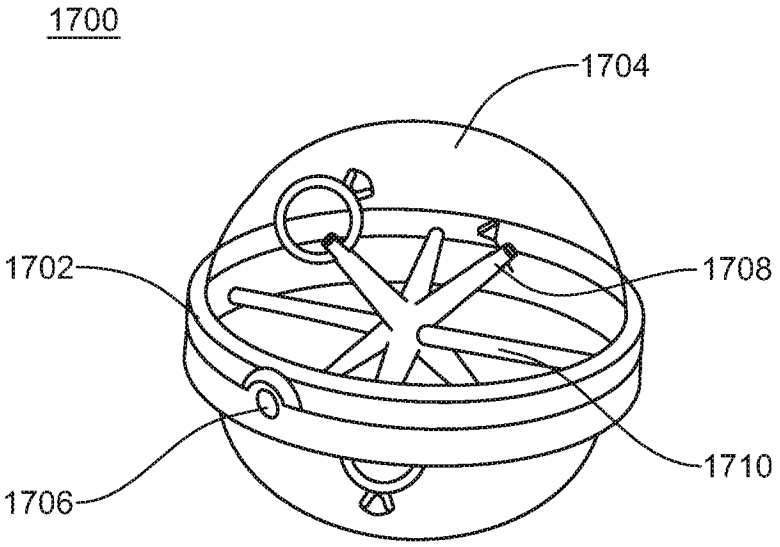
FIG. 17A is a view of an embodiment of an apparatus.

Referring now also to FIGS. 17A and 17B. In some embodiments, the apparatus 1700 may include a frame portion 1702 and a mesh portion 1704. The apparatus may include one or more sections in the inner portion of the apparatus which may include one or more attachment mechanisms 1710, as discussed and described herein. The apparatus may include a latching mechanism 1706 which may be any type of latching mechanism 1706, including, but not limited to, a sliding latch, an interlocking features latch and/or a twisting latch. Various features discussed and described above with respect to latching mechanisms may be included in any one or more of the embodiments of the apparatus described herein. In some embodiments, at least one of the attachment mechanisms may include an attachment mechanism 1708 as shown in magnified view in FIG. 17B. In some embodiments, the attachment mechanism 1708 may include a slot 1712 configured to receive and hold an earring, a ring, a bracelet and/or a necklace or other small parts and/or objects.

Figure 18:
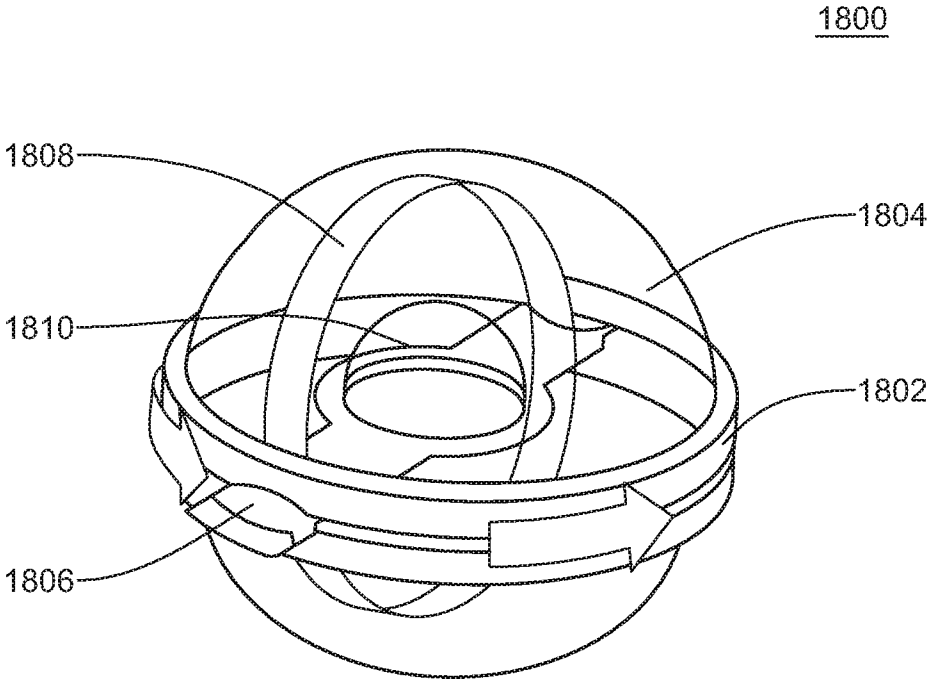
FIG. 18 is a view of an embodiment of an apparatus.

Referring now also to FIG. 18. In some embodiments, the apparatus 1800 may include a frame portion 1802 and a mesh portion 1804. The apparatus may include one or more sections in the inner portion of the apparatus which may include one or more attachment mechanisms 1808, as discussed and described herein. The apparatus may include a latching mechanism 1806 which may be any type of latching mechanism 1806, including, but not limited to, a sliding latch, an interlocking features latch and/or a twisting latch. In the embodiments shown, the latching mechanism 1806 is a twisting latch. Various features discussed and described above with respect to latching mechanisms may be included in any one or more of the embodiments of the apparatus described herein. In some embodiments, the apparatus 1800 may include an area configured to receive an agent 1810. In some embodiments, the area configured to receive an agent 1810 may be a mesh-style pouch. In some embodiments of the apparatus 1800, the apparatus 1800 may be spherical.

Figure 19B:
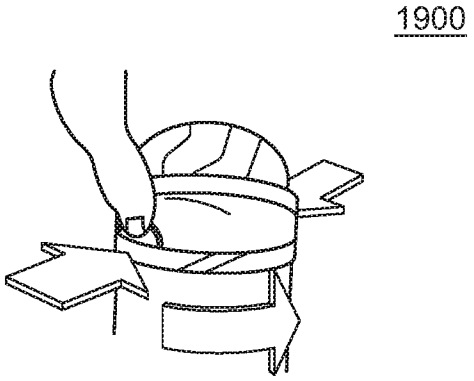
FIG. 19B is a detailed view of the procedure for opening one embodiment of latching mechanism.
Figure 19A:
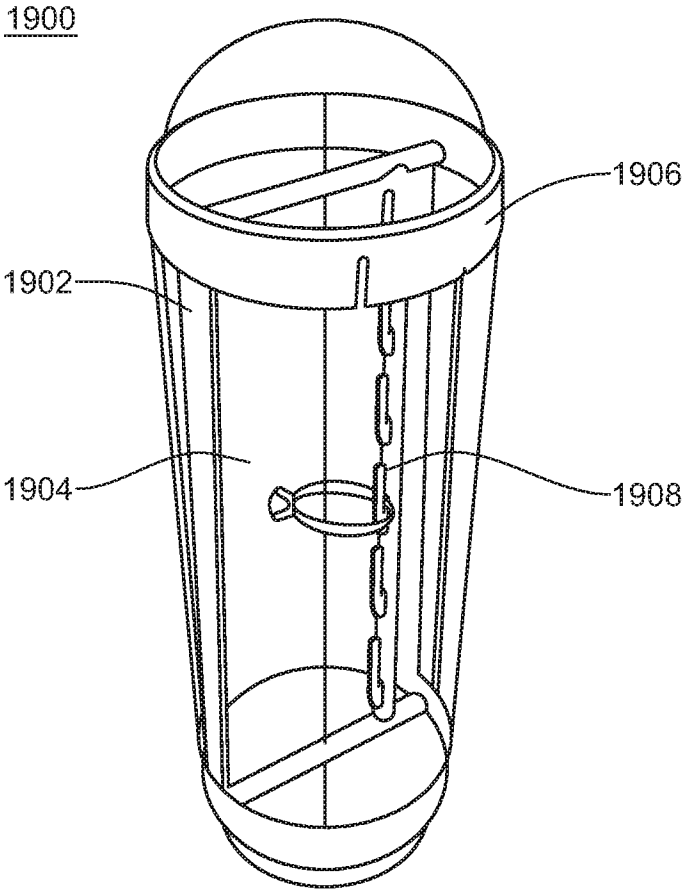
FIG. 19A is a view of an embodiment of an apparatus.

Referring now also to FIGS. 19A and 19B. In some embodiments, the apparatus 1900 may include a frame portion 1902 and a mesh portion 1904. The apparatus may include one or more sections in the inner portion of the apparatus which may include one or more attachment mechanisms 1908, as discussed and described herein. The apparatus may include a latching mechanism 1906 which may be any type of latching mechanism 1906, including, but not limited to, a sliding latch, an interlocking features latch, a pinch and twist latch, a pinch and slide latch and/or a twisting latch. In the embodiments shown, the latching mechanism 1906 is a pinch and twist latch as also shown in FIG. 19B. Various features discussed and described above with respect to latching mechanisms may be included in any one or more of the embodiments of the apparatus described herein. In some embodiments, the apparatus 1900 may include an area configured to receive an agent. In some embodiments of the apparatus 1900, the apparatus 1900 may shaped like an insulated travel container. This may be beneficial for many reasons, including, but not limited to, ease of use in a dishwasher.

Figure 20B:
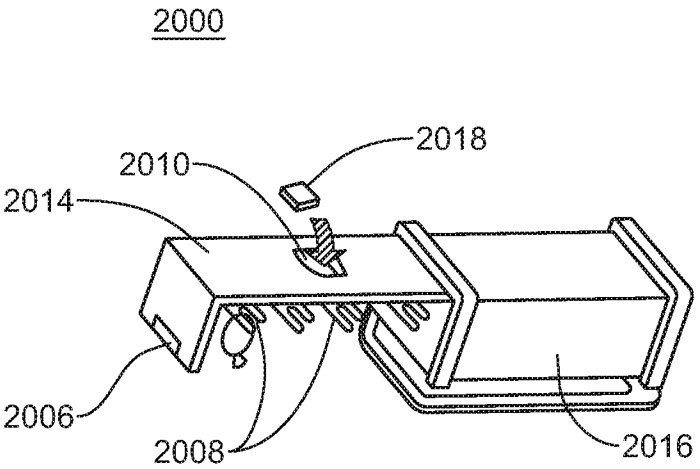
FIG. 20B is a view of an embodiment of the apparatus shown in FIG. 20A in the open position.
Figure 20A:
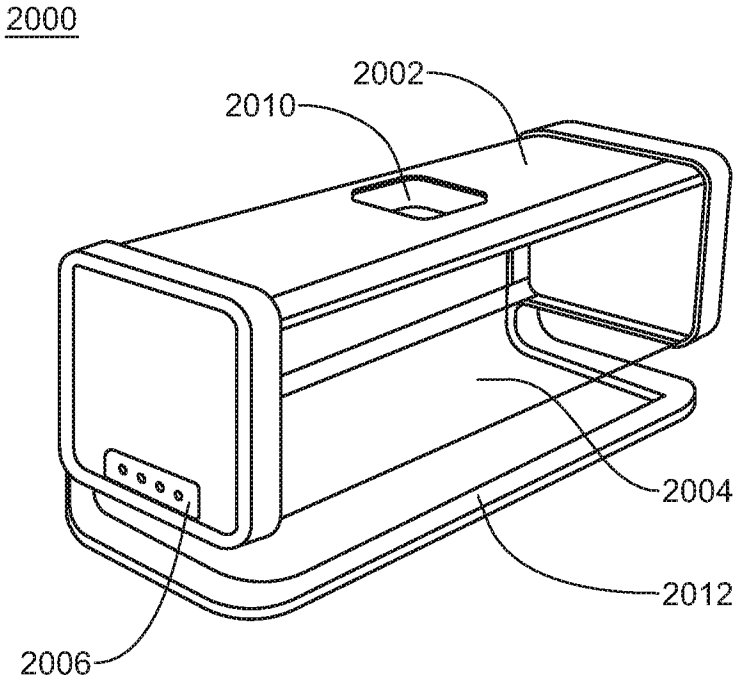
FIG. 20A is a view of an embodiment of an apparatus in the closed position.

Referring now also to FIGS. 20A and 20B. In some embodiments, the apparatus 2000 may include a frame portion 2002 and a mesh portion 2004. The apparatus 2000 may include one or more sections in the inner portion of the apparatus which may include one or more attachment mechanisms 2008, as discussed and described herein. The apparatus 2000 may include a latching mechanism 2006 which may be any type of latching mechanism 2006, including, but not limited to, a sliding latch, an interlocking features latch, a pinch and twist latch, a pinch and slide latch and/or a twisting latch. In the embodiments shown, the latching mechanism 2006 is a slide latch as also shown in FIG. 20B. In various embodiments, the latching mechanism 2006 is slid and then a first portion 2014 of the apparatus 2000 slides out from a second portion 2016 of the apparatus 2000. This may be desirable for many reasons, including, but not limited to, ease of loading small parts/objects into the inner portion of the apparatus 2000. In some embodiments, the apparatus 2000 may include an area configured to receive an agent 2010 which may receive an agent 2018. In some embodiments of the apparatus 2000, the apparatus 2000 may include a rack 2012. This may be beneficial for many reasons, including, but not limited to, ability to hang the apparatus 2000 in a dishwasher using the rack 2012.

Figure 21B:
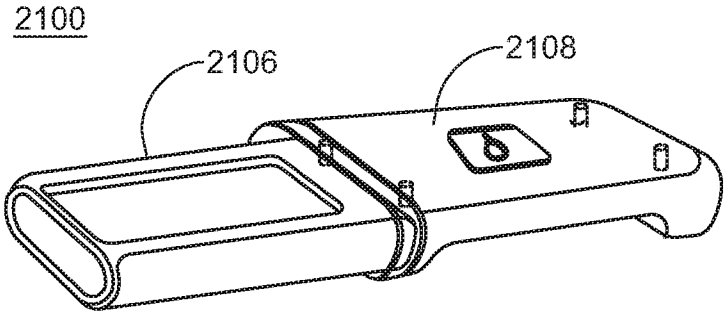
FIG. 21B is a view of an embodiment of the apparatus shown in FIG. 20A in the open position.
Figure 21A:
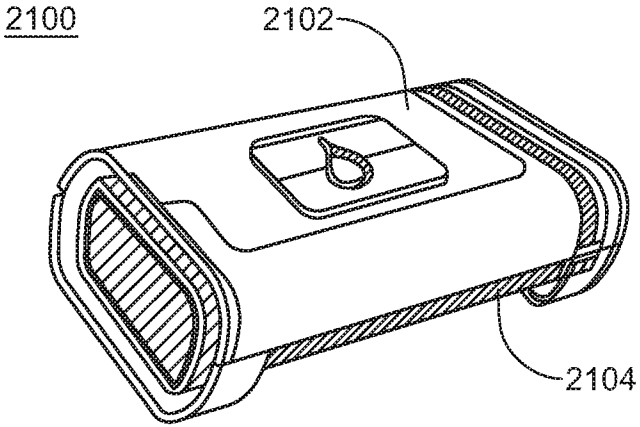
FIG. 21A is a view of an embodiment of an apparatus in the closed position.

Referring now to FIGS. 21A and 21B. In some embodiments, the apparatus 2100 may include a frame portion 2102 and a mesh portion 2104. The apparatus 2100 may include one or more sections in the inner portion of the apparatus which may include one or more attachment mechanisms, as discussed and described herein. The apparatus 2100 may include a latching mechanism which may be any type of latching mechanism 2106, including, but not limited to, a sliding latch, an interlocking features latch, a pinch and twist latch, a pinch and slide latch and/or a twisting latch. In various embodiments, the latching mechanism unlocked and then a first portion 2106 of the apparatus 2100 slides out from a second portion 2108 of the apparatus 2100. This may be desirable for many reasons, including, but not limited to, ease of loading small parts/objects into the inner portion of the apparatus 2100. In some embodiments, the apparatus 2100 may include an area configured to receive an agent which may receive an agent.

Figure 22C:
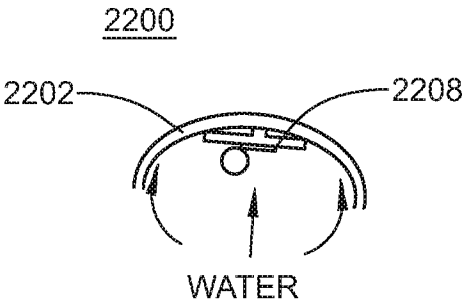
FIG. 22C is a partial illustrative cross sectional view of the embodiment of the apparatus shown in FIGS. 22A and 22B.
Figure 22B:
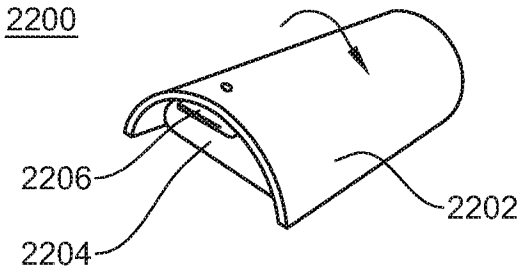
FIG. 22B is an embodiment of the apparatus shown in FIG. 22A in the closed position.
Figure 22A:
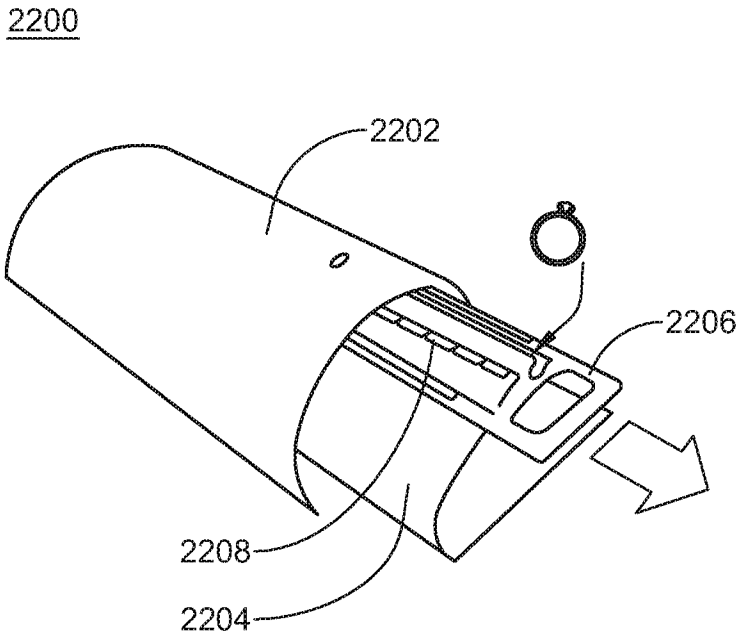
FIG. 22A is a view of an embodiment of an apparatus in a partially opened position.

Referring now also to FIGS. 22A-22C, in some embodiments, the apparatus 2200 may include a frame portion 2202 and a mesh portion 2204. In some embodiments, the mesh portion 2204 may be a bag-like portion of the apparatus 2200. The apparatus 2200 may include one or more sections in the inner portion of the apparatus which may include one or more attachment mechanisms 2208, as discussed and described herein. The attachment mechanism 2208 may include a handle 2206 which may be used to slide the mesh portion 2204 with respect to the frame portion 2202. In some embodiments, the apparatus 2200 may include a latching mechanism, which may be any type of latching mechanism, including, but not limited to, a sliding latch, an interlocking features latch, a pinch and twist latch, a pinch and slide latch and/or a twisting latch. In various embodiments, the latching mechanism may be unlocked and then the mesh portion 2204 of the apparatus 2200 slides out from a frame portion 2206 of the apparatus 2200. This may be desirable for many reasons, including, but not limited to, ease of loading small parts/objects into the inner portion of the apparatus 2200. In some embodiments, the apparatus 2200 may include an area configured to receive an agent which may receive an agent.

Figure 23B:
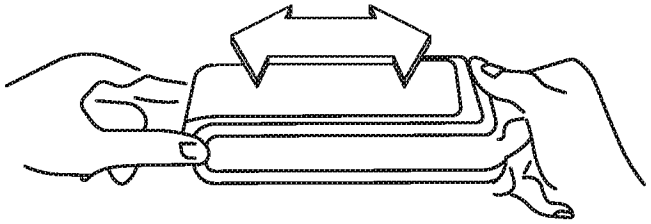
FIG. 23B is an illustrative view of the procedure for opening the embodiment of latching mechanism shown in FIG. 23A.
Figure 23A:
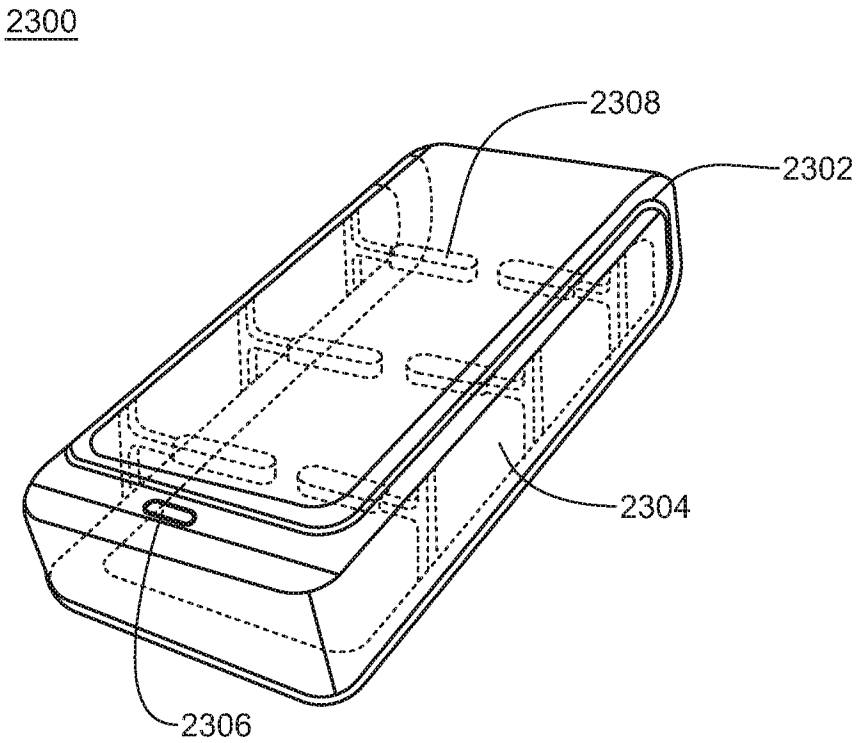
FIG. 23A is a view of an embodiment of an apparatus.

Referring now also to FIGS. 23A and 23B. In some embodiments, the apparatus 2300 may include a frame portion 2302 and a mesh portion 2304. The apparatus 2300 may include one or more sections in the inner portion of the apparatus which may include one or more attachment mechanisms 2308, as discussed and described herein. The apparatus 2300 may include a latching mechanism 2306 which may be any type of latching mechanism 2306, including, but not limited to, a sliding latch, an interlocking features latch, a pinch and twist latch, a pinch and slide latch and/or a twisting latch. In the embodiments shown, the latching mechanism 2306 is a pinch and slide latch as also shown in FIG. 23B. In various embodiments, the latching mechanism 2306 is pinched and then a first portion of the apparatus 2300 slides out from a second portion of the apparatus 2300. This may be desirable for many reasons, including, but not limited to, ease of loading small parts/objects into the inner portion of the apparatus 2300. In some embodiments, the apparatus 2300 may include an area configured to receive an agent which may receive an agent.

Figure 24:
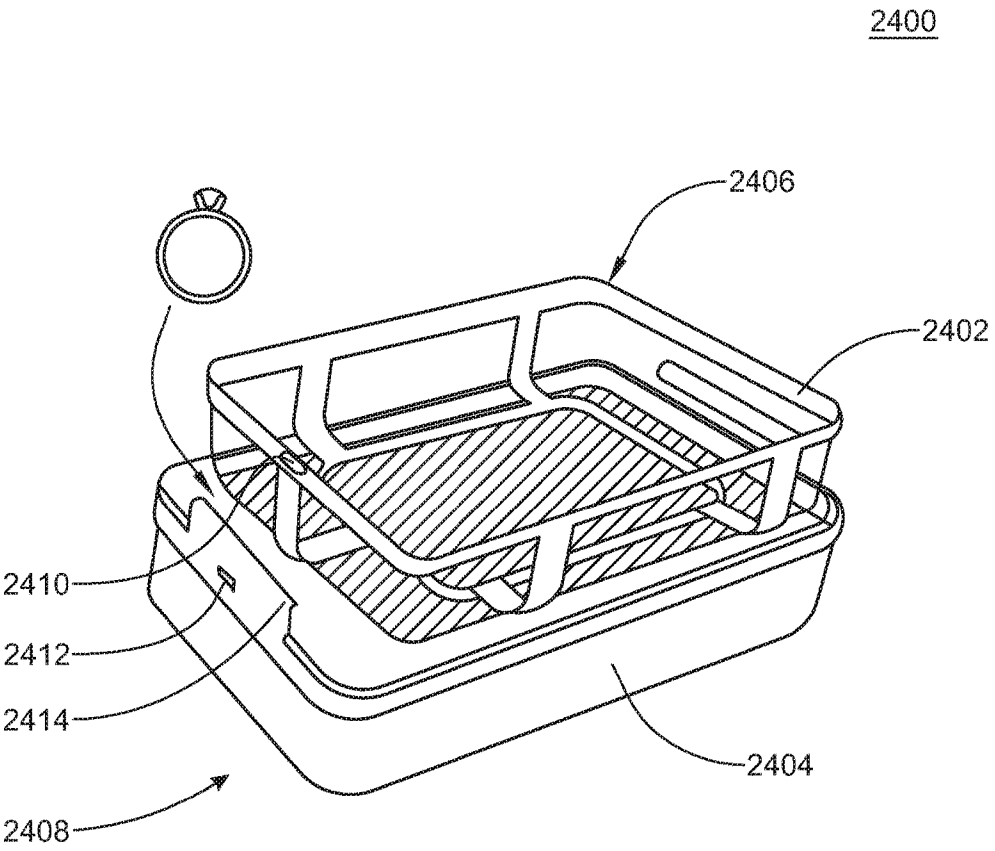
FIG. 24 is a view of an embodiment of an apparatus in a partially opened position.

Referring now also to FIG. 24, in some embodiments, the apparatus 2400 may include a frame portion 2402 and a mesh portion 2404. The apparatus 2400 may include one or more sections in the inner portion of the apparatus 2400 formed by the frame portion 2402. The apparatus 2400 in some embodiments also includes a first portion 2406 and a second portion 2408, the second portion 2408 is configured to receive the first portion 2406. Small parts/objects may be placed within the second portion 2408 and when the first portion 2406 is received by the second portion 2408, the small parts/objects may be held in place by a sandwich between the two portions 2406, 2408 which captures and or compresses the small parts/objects. The frame portion 2402 of the first portion 2406 forms one or more sections in the apparatus 2400 such that the small parts/objects may be compartmentalized. In some embodiments, the apparatus 2400 may include a latching mechanism 2410, 2412, which may be any type of latching mechanism, including, but not limited to, a sliding latch, an interlocking features latch, a pinch and twist latch, a pinch and slide latch and/or a twisting latch. In the embodiments shown, the latching mechanism 2410, 2412 is an interlocking features latch where one feature 2410 in the first portion 2406 interlocks with one feature 2412 of the second portion 2408. In some embodiments, the apparatus 2400 may include an area configured to receive an agent which may receive an agent. In some embodiments of the apparatus 2400, the apparatus 2400 may include at least one hook feature 2414. This may be beneficial for many reasons, including, but not limited to, ability to hook the apparatus 2400 in a dishwasher using the hook feature 2414.

Figure 25B:
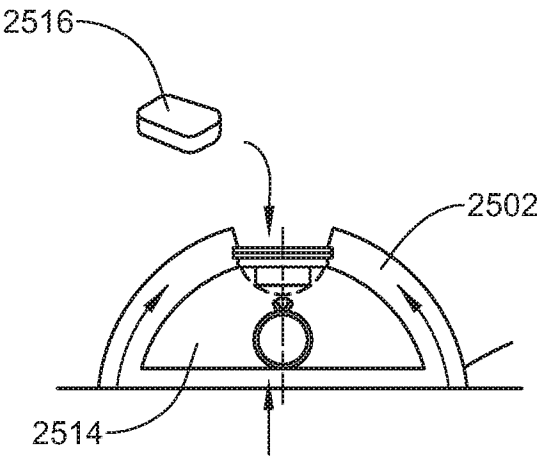
FIG. 25B is an illustrative cross sectional view of the embodiment of the apparatus shown in FIG. 25A in the closed position and illustrating the application of an agent into the apparatus.
Figure 25A:
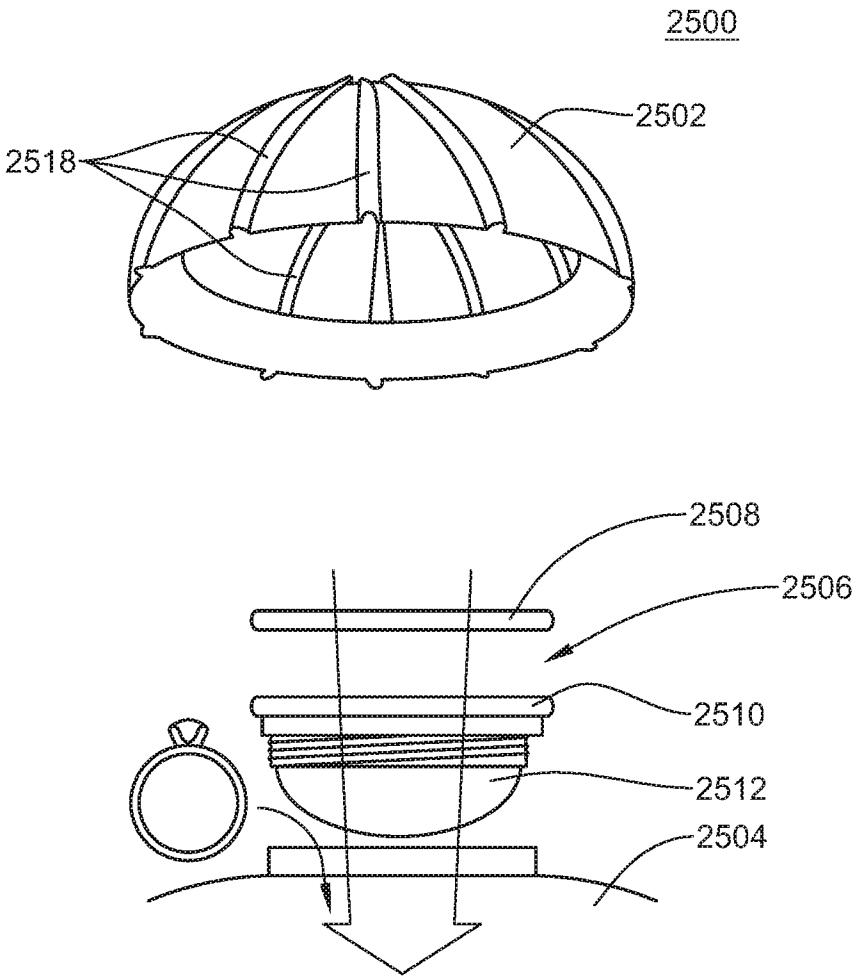
FIG. 25A is a view of one embodiment of an apparatus in an opened position.

Referring now also to FIGS. 25A-25C, in some embodiments, the apparatus 2500 may include a frame portion 2502 and a mesh portion 2504. In some embodiments, the mesh portion 2504 may be a bag-like portion of the apparatus 2500. The apparatus 2500 may include one or more sections in the inner portion 2514 of the apparatus 2500 which may include one or more attachment mechanisms, as discussed and described herein. In some embodiments, the apparatus 2500 may include a latching mechanism, which may be any type of latching mechanism, including, but not limited to, magnetic, a sliding latch, an interlocking features latch, a pinch and twist latch, a pinch and slide latch and/or a twisting latch. In various embodiments, the latching mechanism may be unlocked and then the mesh portion 2504 of the apparatus 2500 slides out from the frame portion 2502 of the apparatus 2500. This may be desirable for many reasons, including, but not limited to, ease of loading small parts/objects into the inner portion 2514 of the apparatus 2500. In some embodiments, the apparatus 2200 may include an area configured to receive an agent 2512 which may receive an agent 2516. In various embodiments, the frame portion 2502 may attach to the mesh portion 2504 through a magnetic interface including a frame portion of the magnetic interface 2508 and a mesh portion of the magnetic interface 2510. In some embodiments, the mesh portion of the magnetic interface 2510 may be connected to the area configured to receive an agent 2512, which, in the embodiments shown, is a mesh bag. In some embodiments, the frame portion 2502 may include at least one ridge 2518 which channel the water. FIG. 25B includes arrows to illustrate water flow.

Figure 26B:
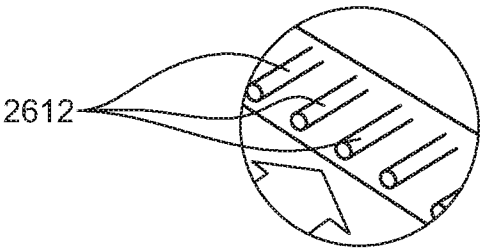
FIG. 26B is a magnified cut-out cross-sectional view of a section of the frame portion of the embodiment of the apparatus shown in FIG. 26A.
Figure 26C:
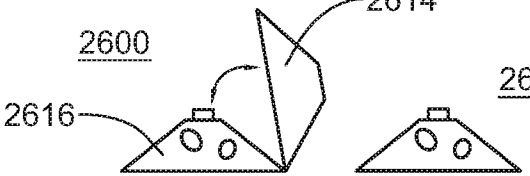
FIG. 26C is an illustrative view of the embodiment of the apparatus shown in FIG. 26A in an open position.
Figure 26D:
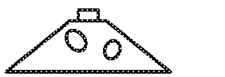
FIG. 26D is an illustrative view of the embodiment of the apparatus shown in FIG. 26C in a closed position.
Figure 26A:
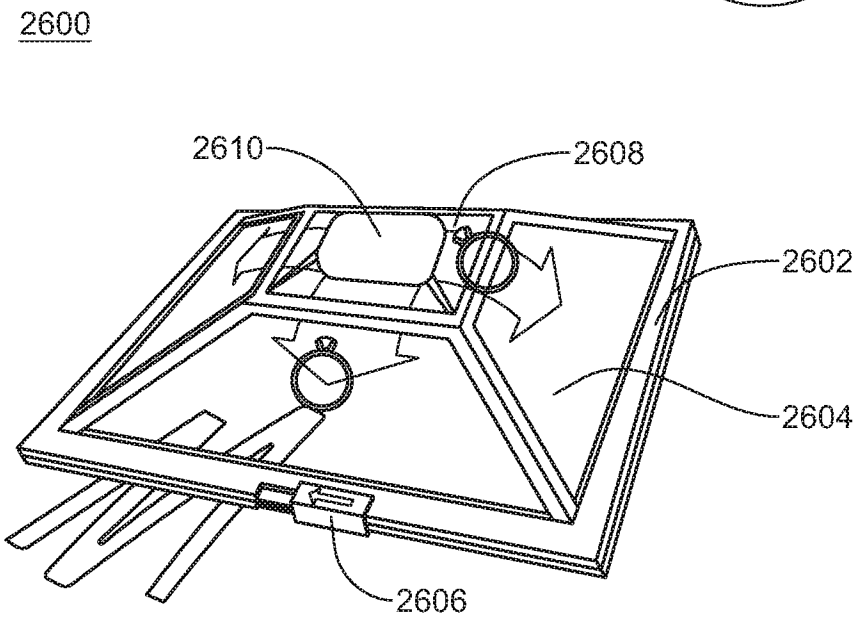
FIG. 26A is a view of an embodiment of an apparatus in the closed position.

In some embodiments, and referring also to FIGS. 26A-26C, the apparatus 2600 may include a frame portion 2602 and a mesh portion 2604. The apparatus may include one or more sections in the inner portion of the apparatus which may include one or more attachment mechanisms, as discussed and described herein. However, in some embodiments, as shown in FIGS. 26A-26C, the inner portion may not include any attachment mechanisms. The apparatus may include a latching mechanism 2606 which may be any type of latching mechanism 2606, including, but not limited to, a sliding latch, an interlocking features latch a pinch and twist latch, a pinch and slide latch and/or a twisting latch. Various features discussed and described above with respect to latching mechanisms may be included in any one or more of the embodiments of the apparatus described herein. There may be many benefits to this configuration of the apparatus 2600 including, but not limited to, the minimal frame portion 2602 structure and large amount of mesh portion 2604 surface area may improve water access to the inner portion of the apparatus 2600. In some embodiments, the apparatus 2600 may include an area configured to receive an agent 2608 which may receive an agent 2610. In some embodiments, the frame portion 2502 may include at least one channel 2612 which channel the water. FIG. 26B includes a cut-away cross sections view to illustrate the channels 2612. In some embodiments, as shown in FIGS. 26C and 26C, the apparatus 2600 may include a first portion 2614 and a second portion 2616. In various embodiments, the first portion 2614 may cover the second portion 2616 when the apparatus 2600 is in the closed position. In some embodiments, the area configured to receive an agent 2608 which may receive an agent 2610 may be located on the second portion 2616. When the first portion 2614 covers the second portion 2616, the agent 2608 is sandwiched in between the first portion 2614 and the second portion 2616.

Figure 27:
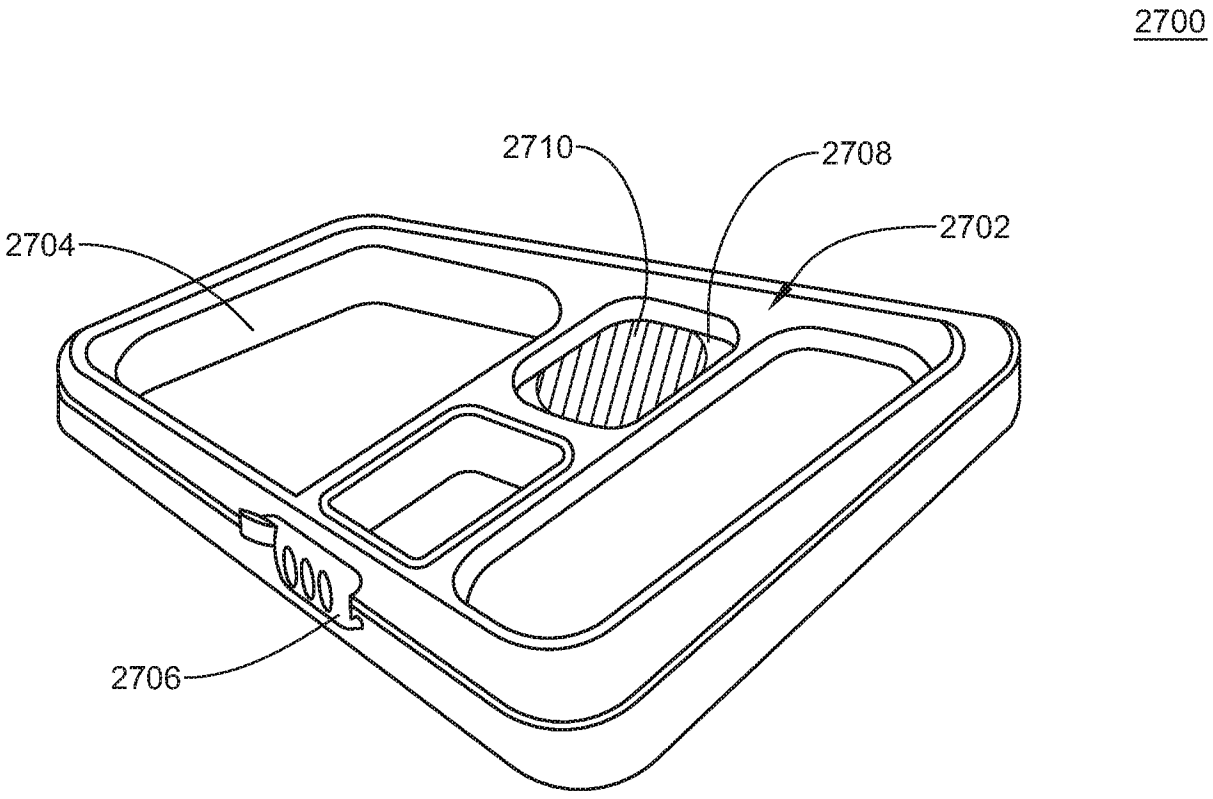
FIG. 27 is a view of an embodiment of an apparatus in the closed position.

Referring now to FIG. 27, the apparatus 2700 may include a frame portion 2702 and a mesh portion 2704. The apparatus 2700 frame portion 2702 may form one or more sections in the inner portion of the apparatus which may include one or more attachment mechanisms, as discussed and described herein. The apparatus may include a latching mechanism 2706 which may be any type of latching mechanism 2706, including, but not limited to, a sliding latch, an interlocking features latch a pinch and twist latch, a pinch and slide latch and/or a twisting latch. Various features discussed and described above with respect to latching mechanisms may be included in any one or more of the embodiments of the apparatus described herein. There may be many benefits to this configuration of the apparatus 2700 including, but not limited to, the minimal frame portion 2702 structure and large amount of mesh portion 2704 surface area may improve water access to the inner portion of the apparatus 2700. In some embodiments, the apparatus 2700 frame portion 2702 may form one or more sections configured to receive an agent 2708 which may receive an agent 2710.

Figure 28:
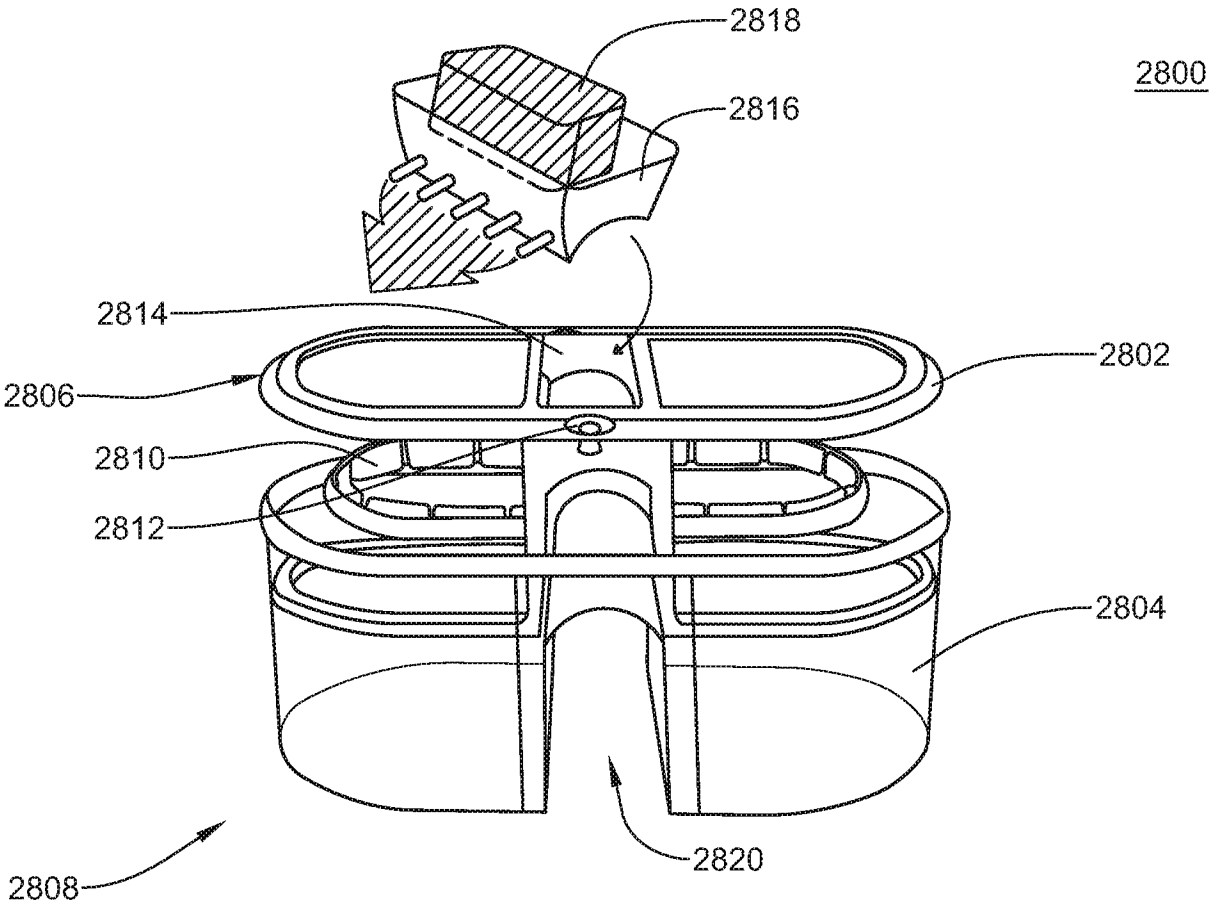
FIG. 28 is a view of an embodiment of an apparatus in the partially opened position.

Referring now also to FIG. 28, in some embodiments, the apparatus 2800 may include a frame portion 2802 and a mesh portion 2804. The apparatus 2800 may include one or more sections in the inner portion of the apparatus 2800 formed by the frame portion 2802. The apparatus 2800 in some embodiments also includes a first portion 2806 and a second portion 2808, the second portion 2808 is configured to receive the first portion 2806. Small parts/objects may be placed within the first portion 2806 which may include one or more attachment mechanisms 2810. When the first portion 2806 is received by the second portion 2808, the latching mechanism 2812 may lock, locking the first portion 2806 to the second portion 2808. The latching mechanism 2812, which may be any type of latching mechanism, including, but not limited to, a sliding latch, an interlocking features latch, a pinch and twist latch, a pinch and slide latch and/or a twisting latch, locks the two portions 2806, 2808 together. In some embodiments, the apparatus 2800 may include an area configured to receive an agent 2816 which may receive an agent 2818. In some embodiments of the apparatus 2800, the first portion 2806 may include an area

2814 for receiving an area configured to receive an agent 2816. In some embodiments, the area configured to receive an agent 2816 may include one or more channels for channeling water and agent into the inner portion of the apparatus 2800 where the small parts/objects are held. In some embodiments of the apparatus 2800, the apparatus 2800 may include at least one hook feature 2820. This may be beneficial for many reasons, including, but not limited to, ability to hook the apparatus 2800 in a dishwasher using the hook feature 2820.

Figure 29:
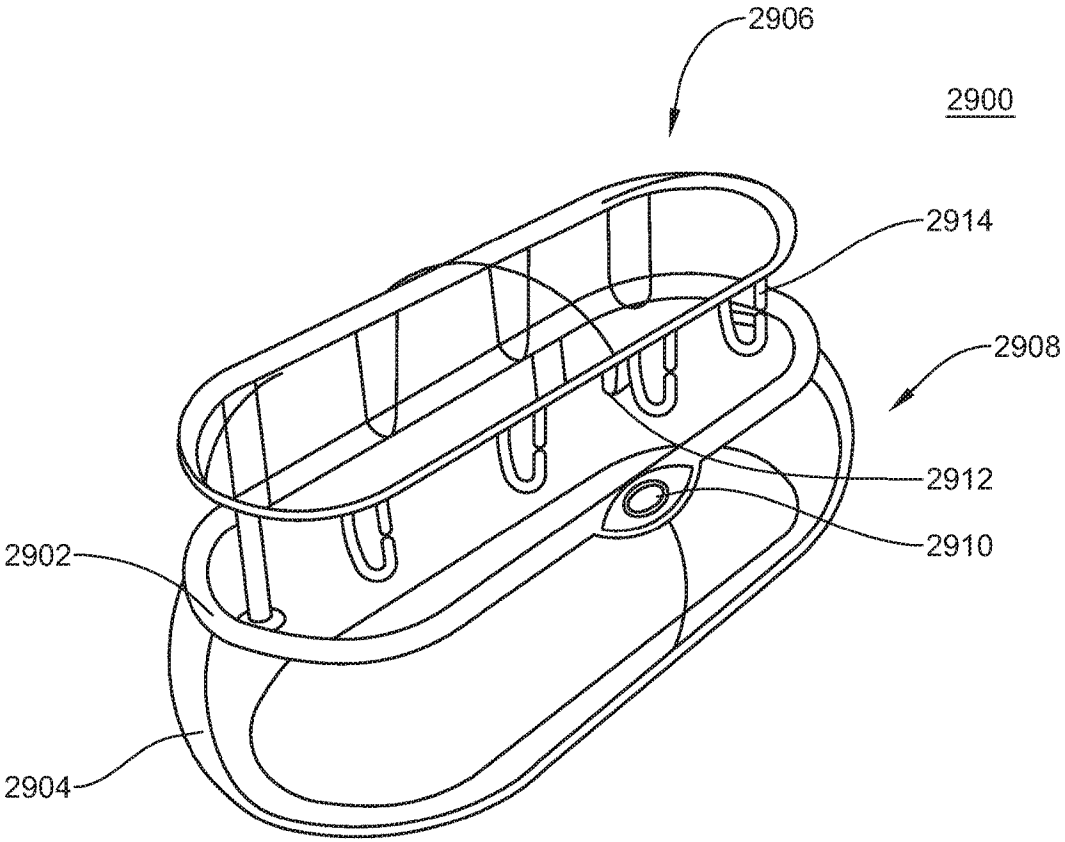
FIG. 29 is a view of an embodiment of an apparatus in the partially opened position.

Referring now also to FIG. 29, in some embodiments, the apparatus 2900 may include a frame portion 2902 and a mesh portion 2904. The apparatus 2900 may include one or more sections in the inner portion of the apparatus 2900 formed by the frame portion 2902. The apparatus 2900 in some embodiments also includes a first portion 2906 and a second portion 2908, the second portion 2908 is configured to receive the first portion 2906. Small parts/objects may be placed within the first portion 2906 which may include one or more attachment mechanisms 2914. When the first portion 2906 is received by the second portion 2908, the latching mechanism 2910, 2912 may lock, locking the first portion 2906 to the second portion 2908. The latching mechanism 2910, 2912, which may be any type of latching mechanism, including, but not limited to, a sliding latch, an interlocking features latch, a pinch and twist latch, a pinch and slide latch and/or a twisting latch, locks the two portions 2906, 2908 together. In the embodiments shown, the latching mechanism may be an interlocking features latch including a first interlocking feature 2912 and a second interlocking feature 2910. In some embodiments, the second interlocking feature 2910 includes a button such that force on the button unlocks the interlocking features 2910, 2912. In some embodiments, the apparatus 2900 may include an area configured to receive an agent which may receive an agent.

Figure 30B:
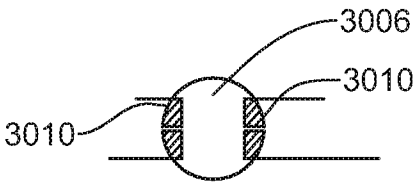
FIG. 30B is a view of an embodiment of a latching mechanism in the open position.
Figure 30C:
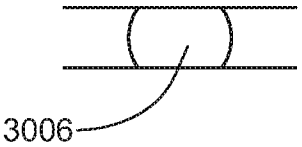
FIG. 30C is a view of the embodiment of a latching mechanism shown in FIG. 30B in the closed position.
Figure 30A:
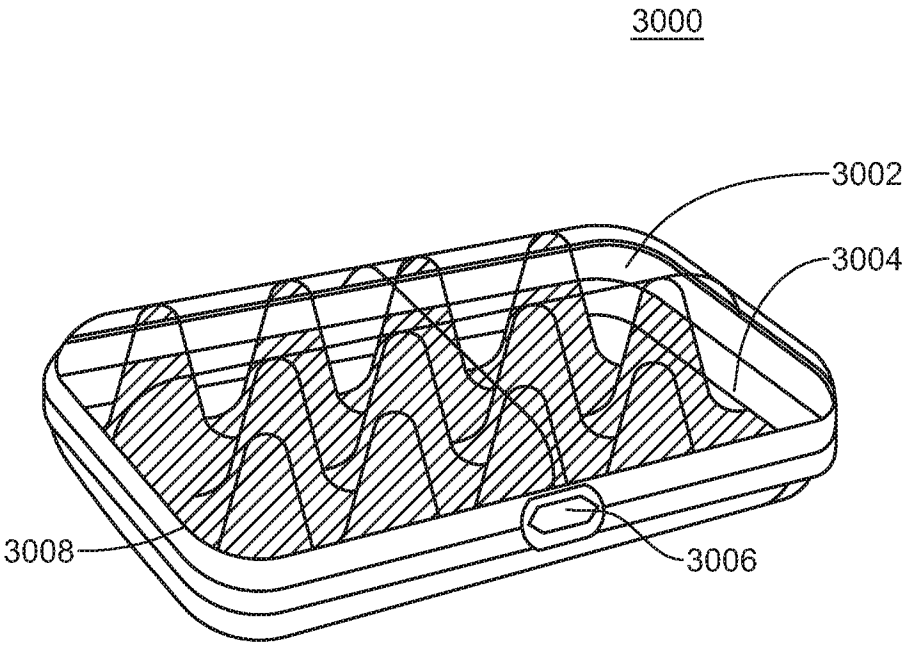
FIG. 30A is a view of an embodiment of an apparatus in the closed position.

Referring now to FIGS. 30A-30C, the apparatus 3000 may include a frame portion 3002 and a mesh portion 3004. The apparatus 3000 mesh portion 3004 may form features, for example, cone features 3008 in the inner portion of the apparatus 3000 which may serve as one or more attachment mechanisms, as discussed and described herein. The apparatus 3000 may include a latching mechanism 3006 which may be any type of latching mechanism 3006, including, but not limited to, a sliding latch, an interlocking features latch, a pinch and twist latch, a pinch and slide latch and/or a twisting latch. In the embodiment shown, the latching mechanism is a twisting latch. As shown in FIGS. 30B and 30C, where FIG. 30B shows the latching feature 3006 in an unlocked configuration and FIG. 30C shows the latching feature 3006 in a locked configuration, in some embodiments, the latching feature 3006, may include a texture and/or color portion that may serve as a tactile and/or visual indicator that the latching mechanism 3006 is either in the unlocked position (as shown in FIG. 30B) or the locked position (as shown in FIG. 30C). This may be beneficial for many reasons, including, but not limited to, visual indication that the apparatus is locked and closed prior to placing the apparatus 3000 in, e.g., a dishwasher, such that the user has assurance that the apparatus 3000 cannot unintentionally open while in the dishwasher or other and/or the small parts, e.g., jewelry, will not be lost/fall out of the apparatus 3000.

The various embodiments of the apparatus presented above include many features that, in various embodiments, may be combined to form additional embodiments. Thus, the various embodiments and features are modular and may be "mixed and matched" in various additional embodiments.

In some embodiments, the various embodiments of the apparatus described herein may be used to clean small parts/objects including, but not limited to, jewelry. The methods include securing the small parts/object/jewelry in the inner portion of the apparatus and in some embodiments this may include securing the small parts/objects/jewelry using one or more attachment mechanism, or otherwise securing the small parts/objects/jewelry by the first portion of the apparatus and the second portion of the apparatus. The apparatus is locked using a latching mechanism such that the small parts/objects/jewelry is contained in the apparatus. In some embodiments, one or more agents may be added to the apparatus. The agents may include, but are not limited to; chemical agents which may include, but are not limited to, a rinsing agent, cleaning agent and/or an anti-microbial agent. The apparatus is then placed within an automatic dishwashing machine. In some embodiments, at least one detergent may be placed in the automatic dishwashing machine, commensurate with regular practice. The automatic dishwashing machine is turned on and the small parts/objects/jewelry is cleaned during the cycling of the automatic dishwashing machine. In some embodiments, antimicrobial and/or rinsing and/or finishing solutions may be added to automatic dishwashing machine in addition to the at least one detergent, however, in some embodiments, one or more of these may be added to the automatic dishwashing machine in place of the at least one detergent. Upon completion of the washing cycle of the automatic dishwashing machine, the apparatus is removed from the automatic dishwashing machine, the apparatus is unlocked and/or opened, and the small parts/objects/jewelry cleaned during the cycling of the automatic dishwashing machine may be removed from the apparatus.

There are many benefits of the apparatus and methods discussed herein, including, but not limited to, disinfection of jewelry for the prevention of the transmission of bacteria and viruses. The use of this apparatus and the methods for cleaning jewelry may greatly diminish the transmission of bacteria and viruses found on rings and other jewelry.

Research has shown that hand hygiene contributes to the spread of disease and infection. Wearing jewelry can contribute to the amount of bacteria found on the hands of people, including, but not limited to, health care and food service workers. Hand hygiene is an area of study focusing on sanitary practices and habits relating to hands in an effort to reduce the spread of bacterial pathogens. Hand hygiene has been found by many clinical studies of healthcare professionals to be a leading cause of hand contamination, which leads to the spread of transient bacteria including pathogenic organisms such as *Staphylococcus aureus* including Methicillin-resistant *S. aureus, Candida* species, Vancomycin-resistant Enterococci and Gram-negative bacilli. Poor hand hygiene significantly increases the spread of pathogenic transient bacteria potentially causing Community Acquired Infections (CAI) and Hospital Acquired Infections (HAI).

Hospital Acquired Infections are the #1 environmental cause of death in America and #4 among all causes behind modifiable behavioral causes tobacco consumption, poor diet and inactivity and alcohol consumption. Nosocomial infections, another name for HAIs, kill more people in our country each year than car accidents, fires and drowning combined. [13] Similar data have also been reported in Europe. [15] Currently in the United States, a patient dies of a hospital acquired infection every six minutes. [14] The annual medical costs of HAIs in U.S. Hospitals are estimated to be between $28 and $45 billion. [1] The Center for Disease Control (CDC) estimates that there were 1.7 million HAIs and 99,000 deaths from HAIs in 2002 and that 1 in 20 patients admitted to the hospital acquire some form of HAI. [2] Of the 99,000 deaths, 20,000 are directly contributed to poor hand hygiene. Infections that patients get in the hospital can be life-threatening and hard to treat. It is well documented that the vast majority of all nosocomial infections are transmitted by contact from patient to patient via the hands of healthcare workers (HCWs) and that hand hygiene is one of the most important ways to prevent the spread of infection. [17].

Reducing the occurrence of cross infection in all institutional settings is a priority, it not only jeopardizes patient health but has an economic impact as well. These infections affect the general health of patients and they are also a huge burden financially. The greatest contributor to these costs are the increased stays that patients with nosocomial infections require. The increased length of stay varies from 3 days for gynecological procedures to 19.8 days for orthopedic procedures. Other costs include additional drugs, the need for isolation, and the use of additional studies. There are also indirect costs due to loss of work. [18]

Nosocomial Infections are characterized as an infection whose development is favored by a hospital environment, such as one acquired by a patient during a hospital visit or one developing among hospital staff. Such infections include fungal and bacterial infections and are aggravated by the reduced resistance of individual patients [3]. The increased risk factors of hospital patients are three fold [4]:

- People in hospitals are usually already in a poor state of health, impairing their defense against bacteria—advanced age or premature birth along with immunodeficiency (due to drugs, illness, or irradiation) present a general risk, while other diseases can present specific risks—for instance, chronic obstructive pulmonary disease can increase chances of respiratory tract infection.
- Invasive devices, for instance IV access devices, catheters, surgical drains, and tracheostomy tubes all bypass the body's natural lines of defense against pathogens and provide an easy route for infection. Patients already colonized on admission are instantly put at greater risk when they undergo an invasive procedure.
- A patient's treatment itself can leave them vulnerable to infection—immunosuppression and antacid treatment undermine the body's defenses, while antimicrobial therapy (removing competitive flora and only leaving resistant organisms) and recurrent blood transfusions have also been identified as risk factors.

Many types of HAIs or Nosocomial Infections are drug resistant such as Methicillin-resistant *S. aureus* (MRSA) and *Acinetobacter*. Due to the ineffectiveness of modern antibiotics on these bacteria, these infections are particularly challenging to treat and often lead to increased patient suffering, costs to treat and possibly even the death of the patient. In the United States, during the 5—year period from 1997 through 2001 the portion of methicillin-resistant *S aureus* causing nosocomial infection continuously increased from 22.4% to 38.7%. [12]

Jewelry Hygiene is an area of study focusing on sanitary practices and habits relating to jewelry in an effort to reduce the spread of bacterial pathogens in particular jewelry's effect on hand hygiene. There are four key elements to optimally sanitizing jewelry: steam, hot water, water pressure and an anti-bacterial cleaning agent. To maintain visibly clean and sanitized jewelry, Jewelry Hygiene pioneer David Bellman G.G recommends each piece of jewelry be cleaned at least once every two weeks. "Jewelry worn in an everyday setting acts as repository for everything you touch, door handles, food preparation, any public place. Your jewelry then becomes a carrier for any potential pathogenic bacteria you come into contact with. The research has shown that even common methods of hand washing do not get the jewelry clean. This is of particular concern for Healthcare Workers as they, more specifically their jewelry, become potential vehicles for the spread of harmful bacteria."

Currently, the best way to keep jewelry visibly clean and sanitized is to bring it to your local jeweler to have it professionally cleaned with equipment costing in excess of $5000. Very few people find this option viable due to the inconvenience, however current in-home options are very limited and are essentially ineffective in leaving the jewelry visibly clean or sanitized or both. In an effort to provide a convenient and affordable solution to the jewelry-cleaning problem, DHB Ventures Group and DEKA Research and Development have partnered to design a Jewelry Cleaning System named the Ringer System for healthcare workers to use in their home or office kitchen.

DHB Ventures group has conducted a number of initial studies including visual inspection with a high-powered magnifying lens as well as Standard Plate Count tests of jewelry. These studies have been conducted to specifically investigate the efficacy of jewelry hygiene methods on control of micro-organisms. These results have been obtained in non-hospital settings, and are generalizable to anyone who wears rings and other jewelry. The standard plate count results, conducted by an independent lab, found most jewelry items to contain high levels of microorganisms. These results are preliminary, and do not identify species-specific data. A pilot study at a partner hospital was conducted to specifically test the jewelry of health care workers and the efficacy of the Ringer System. The Pilot Study is detailed below.

EXAMPLE

The rings of six health care workers were collected and placed in labeled envelopes. A technician wearing gloves collected the rings. They were each tested using the Hygiena EnSURE system and ATP levels were recorded. If a health care worker had more than one ring on the same finger, the rings were swabbed together and considered one piece.

Later that evening, the rings were placed in an embodiment of the apparatus described herein. 10 ml of an antibacterial agent, with the active ingredient Surcide PCMX-USP (0.05%), was dispensed in an area configured to receive an agent located on top portion of the apparatus. The apparatus was placed in a dishwasher to run a 129 minute cycle. A standard dishwashing detergent was used.

After the dishwasher cycle ended, the rings were tested using the same Hygiena EnSURE system and ATP levels were recorded. The rings were given back to the health care workers the following morning. The health care workers were instructed to wear their jewelry as usual.

One week later, the health care workers returned to have the ATP levels tested with the Hygiena EnSURE system and ATP results were recorded. The rings were swabbed with gloved hands at the hospital and given back to the healthcare workers immediately to wear as usual for an additional week.

One more week later, or two weeks after the initial test, the health care workers returned to have the ATP levels tested again with the Hygiena EnSURE system and ATP results were recorded. The rings were swabbed with gloved hands at the hospital and given back the healthcare workers to wear as usual.

The Hygiena EnSURE was the instrument used to collect, analyze, and report the ATP levels. The Ultrasnap/Aquasnap swab tests made for the Hygiena EnSURE system were utilized to measure the ATP levels on each piece of jewelry. ATP or Adenosine Triphosphate is an organic molecule that is used by living cells as energy. Cells, including bacteria, yeast, and mold cells, produce and break down ATP to drive several biological processes. If ATP is present on a surface, it indicates that the surface is not clean and could contain bacteria. The presence of ATP may also indicate that bacterial growth is supported.

Below is a chart indicating the Hygiena Suggested ATP levels of clean, used to quantify the ATP levels in this study:

| Categories | ATP Levels |
|---|---|
| Ultra Clean<br>Sterile surfaces & food prep areas | 0-10 |
| Very Clean<br>Critical touch pts; considered sanitized | 11-30 |
| Good Clean<br>Floor req'mt & typical microfiber towel performance | 31-80 |
| Somewhat Dirty<br>Caution: surface should be cleaned & has some risk of contamination from disease causing bacteria | 81-200 |
| Dirty<br>Warning: surface needs cleaning & has medium risk of contamination from disease causing bacteria | 201-500 |
| Very Dirty<br>Danger: surface needs cleaning & has med to high risk of contamination from disease causing bacteria | 501-1000 |
| Filthy<br>Danger: surface needs cleaning & has high risk of contamination from disease causing bacteria | >1000 |

The Hygiena EnSURE luminometer system works by detecting small amounts of light generated from chemical reactions that take place after a sample is taken. An ATP reaction looks like:

Luciferin/Luciferace(buffer)+ATP=Light [EQN #1]

The Hygiena EnSURE numeric readings are displayed as Relative Light Unit (RLU) values. The light produced by the Luciferin/Luciferace and ATP reaction produces light in the form of photons. Photons are a particle and the basic unit of light. The Hygiena EnSURE system detects the photons and converts them into RLU values. The more light, the higher the RLU reading. The higher the RLU readings, the higher the amount of contamination on the sample.

To perform each ATP test, a swab is removed from a new test tube and rotated on the surface of one piece of jewelry to capture a sample. Once the swab (sample) is placed back in the test tube, the plastic Snap Valve is broken to release the buffer down the swab shaft. While in the buffer reagent, any ATP contained on the swab is released. The ATP is now available to react. The test tube is shaken for 5 seconds and then placed in the Hygiena EnSURE device and the lid is closed. The EnSURE device is held upright until a number is available. If ATP is present, light is produced and reflected in the number.

In some embodiments, the apparatus, system and method utilize an anti-bacterial cleaning agent with the active ingredient Surcide PCMX-USP (0.05%). Surcide PCMX-USO is a broad spectrum antimicrobial which is effective against bacteria (both Gram positive and Gram negative) and fungi (yeast and molds). It is bactericidal in addition to bacteriostatic, and is used to formulate a variety of antimicrobial handwash products.

The results of the initial testing showed that ATP levels on the participants' rings ranged from levels that indicated that they were Dirty to Filthy before cleaning and after cleaning using the apparatus, system and methods described herein, ranged from Ultra Clean to Very Clean. Results are shown in a chart below:

| | ATP Results Before Cleaning | ATP Results After Cleaning | ATP Results 1 Wk after cleaning | ATP Results 2 Wks after cleaning |
|---|---|---|---|---|
| Ring 1 | 2,131 | 54 | 272 | 253 |
| Ring 2 | 666 | 4 | 218 | 340 |
| Ring 3 | 1,738 | 10 | 108 | 560 |
| Ring 4 | 1,290 | 40 | 28 | 130 |
| Ring 5 | 133 | 1 | 123 | 449 |
| Ring 6 | 1,539 | 12 | 125 | 324 |
| | 1,250 | 20 | 146 | 343 |

The initial phase of testing show significant bacterial colonization with 5 of 6 rings measuring Very Dirty to Filthy and 4 of 6 rings measuring Filthy. The average reading was an ATP score of 1,250 meaning the rings average above a rating of Filthy. After cleaning the jewelry with the Ringer System the average reading was 20, an equivalent rating of Very Clean or sanitary. Additionally, 6 of 6 rings rated clean or better with 4 of 6 rating Very Clean (sanitary) or better and 3 of 6 rating Ultra Clean (sterile).

The results of testing 1 week after cleaning displayed an increase in bacterial colonization with only 1 of 6 rings rating clean or better. Additionally, 4 of 6 rings rated Somewhat Dirty or worse with 2 of 6 rings rating Dirty, with an average rating of 146, the equivalent of a Somewhat Dirty rating.

The results of testing 2 weeks after cleaning again displayed a continued increase in bacterial colonization, no rings rating clean or better. Additionally, 5 of 6 rings rated Dirty or worse, 1 of 6 rings rating Very Dirty. The average rating was 343, the equivalent of a Dirty rating.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A method for cleaning jewelry in a dishwasher appliance comprising:

providing a cleaning container apparatus comprising:

a top portion;

bottom portion, wherein the top portion and the bottom portion comprising a mesh portion;

at least one hinging feature attached to the bottom portion; and at least one spring holder attached to the at least one hinging feature, wherein the top portion and bottom portion move from a closed position to a open position, and wherein when the top portion and the bottom portion move from the closed position to the open position, the at least one spring holder lifts upwards, wherein the top portion comprising a basin, having a floor, formed as a depressed portion on the top portion, wherein the basin further comprising a reservoir cavity, wherein the reservoir cavity is configured to receive an agent while the container is in the closed position;

placing at least one item of jewelry inside the cleaning container apparatus; placing the cleaning container apparatus into a dishwasher appliance; and running the dishwasher appliance through a cleaning cycle while the cleaning container apparatus is in the dishwasher appliance.

2. The method of claim 1, wherein the top portion and bottom portion forming an inner portion, wherein the floor of the basin comprising at least one opening connecting the reservoir cavity with the inner portion.

3. The method of claim 2, wherein the reservoir cavity is a hollow container attached to the floor of the basin.

4. The method of claim 3, wherein the reservoir cavity comprising a displaceable reservoir top.

5. The method of claim 1, wherein the reservoir cavity comprising at least one wall defining a gutter wherein the gutter provides a passage between the basin and the reservoir cavity.

6. The method of claim 1, wherein the reservoir cavity comprising at least one dividing wall.

7. The method of claim 1, wherein the top portion comprising:

a top outer portion;

a top middle portion; and a top inside portion, wherein the top outer portion, the top middle portion, the top mesh portion and the top inside portion are attached.

8. The method of claim 1, wherein the bottom portion comprising:

a bottom inside portion; and a bottom outside portion, wherein the bottom inside portion, the bottom mesh portion and the bottom outside portion are attached.

9. The method of claim 1, wherein the at least one hinging feature comprising:

at least one interlocking bottom hinging feature;

at least one interlocking top hinging feature; and a dowel, wherein the at least one interlocking bottom hinging feature and the at least one interlocking top hinging feature interlock with each other and wherein the dowel slidably attaches within the interlocking bottom and top features.

10. The method of claim 1, wherein the inner portion comprising:

at least one attachment mechanism.

11. The method of claim 10, wherein the at least one attachment mechanism is at least one clip.

12. The method of claim 10, wherein the at least one attachment mechanism is at least one hook.

13. The method of claim 1, wherein the at least one spring holder comprising at least one aperture.

14. The method of claim 1, wherein the at least one spring holder comprising at least one dividing portion.

15. A method for cleaning jewelry in a dishwasher appliance comprising:

providing a cleaning container apparatus comprising:

a top portion;

bottom portion, wherein the top portion and the bottom portion comprising a mesh portion;

wherein the top portion comprising a basin, having a floor, formed as a depressed portion on the top portion, wherein the basin further comprising a reservoir cavity, wherein the reservoir cavity is configured to receive an agent while the container is in the closed position;

placing at least one item of jewelry inside the cleaning container apparatus;

placing the cleaning container apparatus into a dishwasher appliance; and running the dishwasher appliance through a cleaning cycle while the cleaning container apparatus is in the dishwasher appliance.

16. The method of claim 15, wherein the top portion and the bottom portion forming an inner portion, wherein the floor of the basin comprising at least one opening connecting the reservoir cavity with the inner portion.

17. The method of claim 16, wherein the reservoir cavity is a hollow container attached to the floor of the basin.

18. The method of claim 17, wherein the reservoir cavity comprising a displaceable reservoir top.

19. The method of claim 15, wherein the reservoir cavity comprising at least one wall defining a gutter wherein the gutter provides a passage between the basin and the reservoir cavity.

20. The method of claim 15, wherein the reservoir cavity comprising at least one dividing wall.

* * * * *